US008167401B2

(12) United States Patent
Kyoso

(10) Patent No.: US 8,167,401 B2
(45) Date of Patent: May 1, 2012

(54) LIQUID EJECTION APPARATUS AND IMAGE FORMING APPARATUS

(75) Inventor: Tadashi Kyoso, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 1128 days.

(21) Appl. No.: 11/607,864

(22) Filed: Dec. 4, 2006

(65) Prior Publication Data

US 2007/0126779 A1 Jun. 7, 2007

(30) Foreign Application Priority Data

Dec. 5, 2005 (JP) ..... 2005-350723

(51) Int. Cl.
*B41J 2/165* (2006.01)

(52) U.S. Cl. ..... 347/30

(58) Field of Classification Search ..... None
See application file for complete search history.

(56) References Cited

U.S. PATENT DOCUMENTS

| | | | | |
|---|---|---|---|---|
| 4,999,651 | A * | 3/1991 | Duffield et al. | 347/3 |
| 6,494,560 | B1 * | 12/2002 | Seshimo et al. | 347/23 |
| 2002/0130918 | A1 | 9/2002 | Hayakawa et al. | |
| 2005/0285913 | A1 * | 12/2005 | Yoshino et al. | 347/85 |

FOREIGN PATENT DOCUMENTS

| | | | |
|---|---|---|---|
| JP | 63-95948 | A | 4/1988 |
| JP | 9-201982 | A | 8/1997 |
| JP | 2000-225715 | A | 8/2000 |
| JP | 2003-145782 | A | 5/2003 |

OTHER PUBLICATIONS

Office Action dated Dec. 10, 2010 for Japanese Application No. 2005-350723.

* cited by examiner

*Primary Examiner* — Matthew Luu
*Assistant Examiner* — Alejandro Valencia
(74) *Attorney, Agent, or Firm* — Birch, Stewart, Kolasch & Birch, LLP

(57) ABSTRACT

The liquid ejection apparatus includes: a liquid ejection head which has a nozzle surface including a plurality of nozzles; a cap device which comes in contact with the nozzle surface of the liquid ejection head and enables liquid inside the nozzles to be suctioned or pressurized; and a selection device which selects whether or not the liquid inside the nozzles is suctioned or pressurized, for each of at least two nozzle groups into which the nozzles are divided.

9 Claims, 19 Drawing Sheets

LIQUID EJECTION APPARATUS AND IMAGE FORMING APPARATUS

BACKGROUND OF THE INVENTION

1. Field of the Invention

The present invention relates to a liquid ejection apparatus and an image forming apparatus, and more particularly, to a liquid ejection apparatus in which suctioning or pressurization of liquid inside a plurality of nozzles provided in a liquid ejection head is carried out in a state where a cap is in contact with a nozzle surface of the liquid ejection head.

2. Description of the Related Art

An inkjet recording apparatus forms a desired image on a recording medium by ejecting ink droplets selectively from a plurality of nozzles installed in an inkjet head (hereinafter, simply called a "head"). In recent years, very large numbers of nozzles have been installed at high density in the head, in order to achieve high-quality recording and high-speed recording.

The nozzles of a head of this kind are always in an ink-filled state, and if a state where no ejection from a nozzle is performed continues for a long period of time, then the ink in the vicinity of the meniscus (i.e., ink surface) increases in viscosity, the ink dries, and ejection defects such as nozzle blockages may occur eventually. Therefore, it is necessary to carry out a maintenance operation which expels the defective ink inside nozzles, by placing a cap on the nozzle surface of the head and then suctioning or pressurizing the ink inside the nozzles. However, in many cases, these maintenance operations are implemented at all of the nozzles, and therefore a large amount of ink is consumed wastefully.

Japanese Patent Application Publication No. 2000-225715 discloses an inkjet printer which suppresses wasteful consumption of ink by dividing the nozzles into a plurality of nozzle groups and suctioning the nozzles individually on a nozzle group basis.

However, in the inkjet printer disclosed in Japanese Patent Application Publication No. 2000-225715, it is necessary to provide a suction selection device, such as an electromagnetic valve, on the cap side, for each nozzle group unit. Hence, the costs tend to be high.

SUMMARY OF THE INVENTION

The present invention has been contrived in view of the foregoing circumstances, an object thereof being to simplify the cap structure and to reduce the overall manufacturing costs by using a portion of the ejection mechanism of the head as a selection device for the suctioning or pressurization.

In order to attain the aforementioned object, the present invention is directed to a liquid ejection apparatus comprising: a liquid ejection head which has a nozzle surface including a plurality of nozzles; a cap device which comes in contact with the nozzle surface of the liquid ejection head and enables liquid inside the nozzles to be suctioned or pressurized; and a selection device which selects whether or not the liquid inside the nozzles is suctioned or pressurized, for each of at least two nozzle groups into which the nozzles are divided.

According to this aspect of the present invention, a selection device is provided in the liquid ejection head, and it selects whether or not the liquid inside the nozzles is suctioned or pressurized with respect to each nozzle group, and thus the structure of the cap can be simplified and the overall manufacturing costs can be reduced.

A mode is possible in which a plurality of selection devices are provided for the nozzle groups respectively and each of the selection devices comprises: an opening and closing section (valve main body) which opens or closes a flow channel for suctioning or pressurizing the liquid in a nozzle(s); and a drive section for opening and closing the opening and closing section.

Preferably, the liquid ejection apparatus further comprises first piezoelectric elements which are respectively provided for the nozzles in the liquid ejection head, wherein the liquid is ejected from each of the nozzles by using displacement of each of the first piezoelectric elements.

Preferably, the liquid ejection apparatus further comprises: connection paths which are provided for the nozzle groups respectively and each have two openings at the nozzle surface of the liquid ejection head; second piezoelectric elements which are provided on wall surfaces of the connection paths respectively; first flow channels which are provided in the cap device so as to correspond to the nozzle groups respectively; and a second flow channel which is provided in the cap device and is connected to a pump, wherein: the first flow channels are connected to the second flow channel through the connection paths, in a state where the cap device is in contact with the nozzle surface of the liquid ejection head; and each of the connection paths is partially opened or closed in accordance with displacement of each of the second piezoelectric elements.

According to this aspect of the present invention, it is possible to change the open/closed state of each connection path in stages, by controlling a drive voltage applied to each second piezoelectric element. Accordingly, the amount of liquid suctioning or the amount of liquid pressurization can be varied with respect to each nozzle group, and therefore wasteful consumption of the ink can be reduced yet further.

Preferably, the liquid ejection apparatus further comprises first piezoelectric elements which are respectively provided for the nozzles in the liquid ejection head, wherein: the liquid is ejected from each of the nozzles by using displacement of each of the first piezoelectric elements; and the first piezoelectric elements and the second piezoelectric elements have a common structure.

According to this aspect of the present invention, it is possible to simplify the manufacturing process and to reduce the manufacturing costs of the liquid ejection head.

Preferably, the liquid ejection apparatus further comprises coupling films which are respectively provided in the connection paths of the liquid ejection head and are respectively displaced in conjunction with the displacement of the second piezoelectric elements, wherein each of the connection paths is partially opened or closed in accordance with displacement of each of the coupling films.

According to this aspect of the present invention, the displacement of each second piezoelectric element can be amplified because of the coupling film, and therefore it is possible to reduce the size of each second piezoelectric element and the size of the portion of each connection path corresponding to each second piezoelectric element.

Preferably, the liquid ejection apparatus further comprises ejection failure determination devices which are provided in the liquid ejection head and each determine a liquid ejection defect, wherein the selection device selects whether or not the liquid inside the nozzles is suctioned or pressurized, for each of the nozzle groups, in accordance with determination results of the ejection failure determination devices.

According to this aspect of the present invention, it is possible to reduce wasteful consumption of the ink yet further.

Preferably, the liquid ejection apparatus further comprises: connection paths which are provided for the nozzle groups respectively and each have two openings at the nozzle surface of the liquid ejection head; and second piezoelectric elements which are respectively provided on wall surfaces of the connection paths, wherein: each of the connection paths is partially opened or closed in accordance with displacement of each of the second piezoelectric elements; and at least a portion of each of the ejection failure determination devices constitutes a coupling film which is displaced in conjunction with the displacement of each of the second piezoelectric elements.

According to this aspect of the present invention, the manufacturing costs of the liquid ejection head can be reduced.

Preferably, the coupling film which is constituted by at least a portion of each of the ejection failure determination devices is made of polyvinylidene difluoride.

According to this aspect of the present invention, since PVDF (polyvinylidene difluoride) has poor reactivity, it has good stability when exposed to air or ink. Furthermore, PVDF has a low Young's modulus of 2 to 3 GPa, and therefore can generate a large amount of displacement.

In order to attain the aforementioned object, the present invention is also directed to an image forming apparatus comprising a liquid ejection apparatus comprising: a liquid ejection head which has a nozzle surface including a plurality of nozzles; a cap device which comes in contact with the nozzle surface of the liquid ejection head and enables liquid inside the nozzles to be suctioned or pressurized; and a selection device which selects whether or not the liquid inside the nozzles is suctioned or pressurized, for each of at least two nozzle groups into which the nozzles are divided.

According to the present invention, the liquid ejection head includes a selection device which selects whether or not the liquid inside nozzles is suctioned or pressurized, for each nozzle group, and thus the structure of the cap can be simplified and the overall manufacturing costs can be reduced.

BRIEF DESCRIPTION OF THE DRAWINGS

The nature of this invention, as well as other objects and benefits thereof, is explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
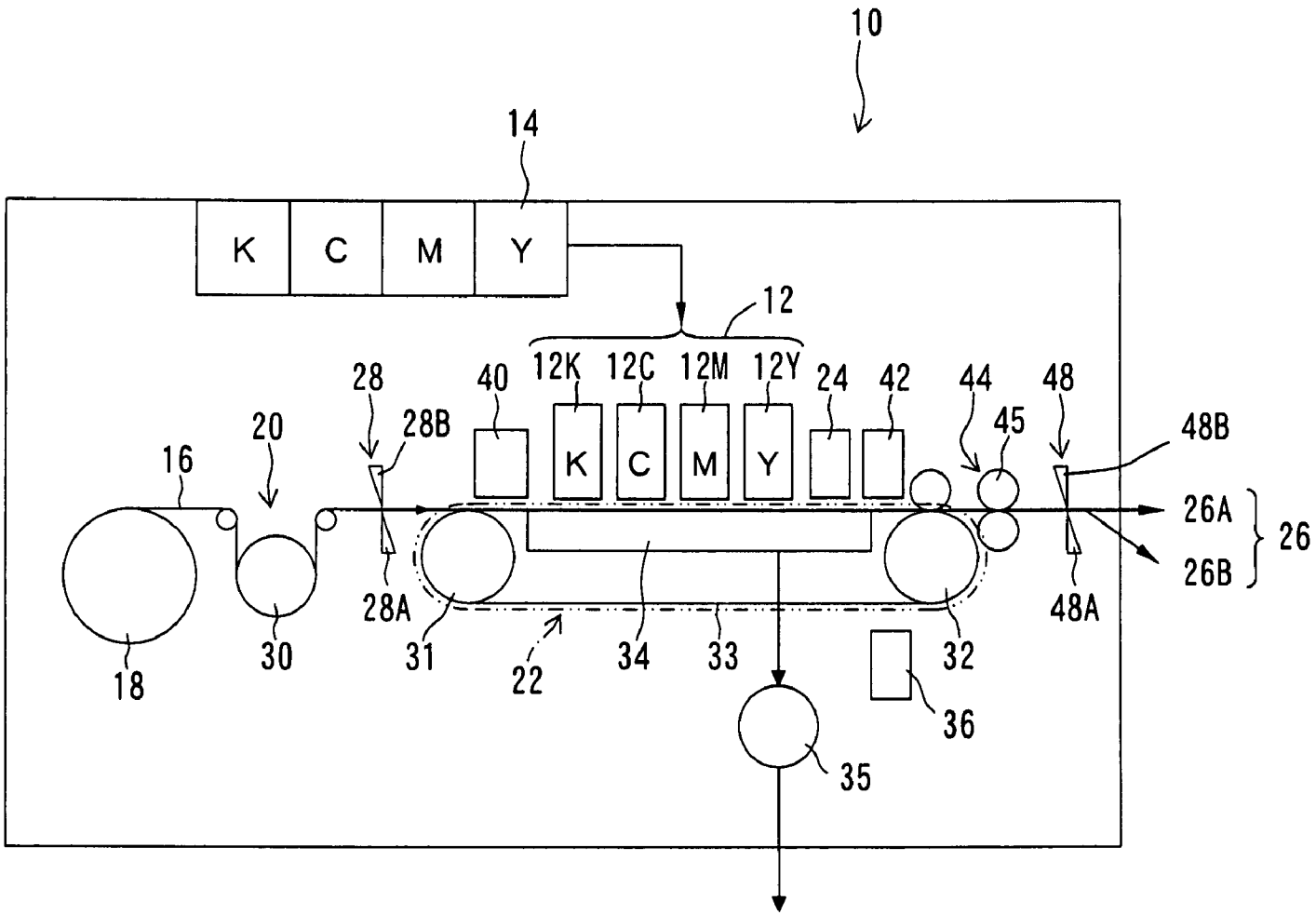
FIG. 1 is a general compositional view showing an inkjet recording apparatus according to a first embodiment of the invention.

FIG. 1 is a general schematic drawing showing a general view of an inkjet recording apparatus. As shown in FIG. 1, the inkjet recording apparatus 10 comprises: a printing unit 12 having a plurality of heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A which has a length not less than the width of the conveyor pathway of the recording paper 16, and a round blade 28B which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper be attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl because of having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown in FIG. 1) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration of nipping of a brush roller or a water absorbent roller or the like, an air blow configuration in which clean air is blown, or a combination of these. In the case of the configuration of nipping of the cleaning rollers, it is preferable to make the line velocity of the cleaning rollers different from the line velocity of the belt, in order to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). The heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The heads 12K, 12C, 12M and 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the heads 12K, 12C, 12M, and 12Y, respectively, onto the recording paper 16 while the recording paper 16 is being conveyed.

The print unit 12, in which the full-line heads covering the entire width of the paper are thus provided for the respective ink colors, can record an image over the entire surface of the recording paper 16 by performing an action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a head moves reciprocally in a direction (main scanning direction) which is perpendicular to the paper conveyance direction (sub-scanning direction).

Furthermore, although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added.

As shown in FIG. 1, the ink storing and loading unit 14 has tanks for storing inks of the colors corresponding to the respective heads 12K, 12C, 12M and 12Y, and the tanks are connected to the respective heads 12K, 12C, 12M, 12Y, via tube channels (not shown). Moreover, the ink storing and loading unit 14 also comprises: a notifying device (display device, alarm generating device, or the like) for generating a notification if the remaining amount of ink has become low; and a mechanism for preventing incorrect loading of ink of the wrong color.

The print determination unit 24 has an image sensor (line sensor) for capturing an image of an ink-droplet deposition result of the printing unit 12, and functions as a device to check for ejection defects, such as clogs of the nozzles in the printing unit 12, from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In the cases in which printing is performed with dye-based ink on porous paper, blocking the pores of the paper by the application of pressure prevents the ink from coming in contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

The heads 12K, 12C, 12M and 12Y of the respective ink colors have the same structure, and a reference numeral 50 is hereinafter designated to any of the heads.

Figure 2:
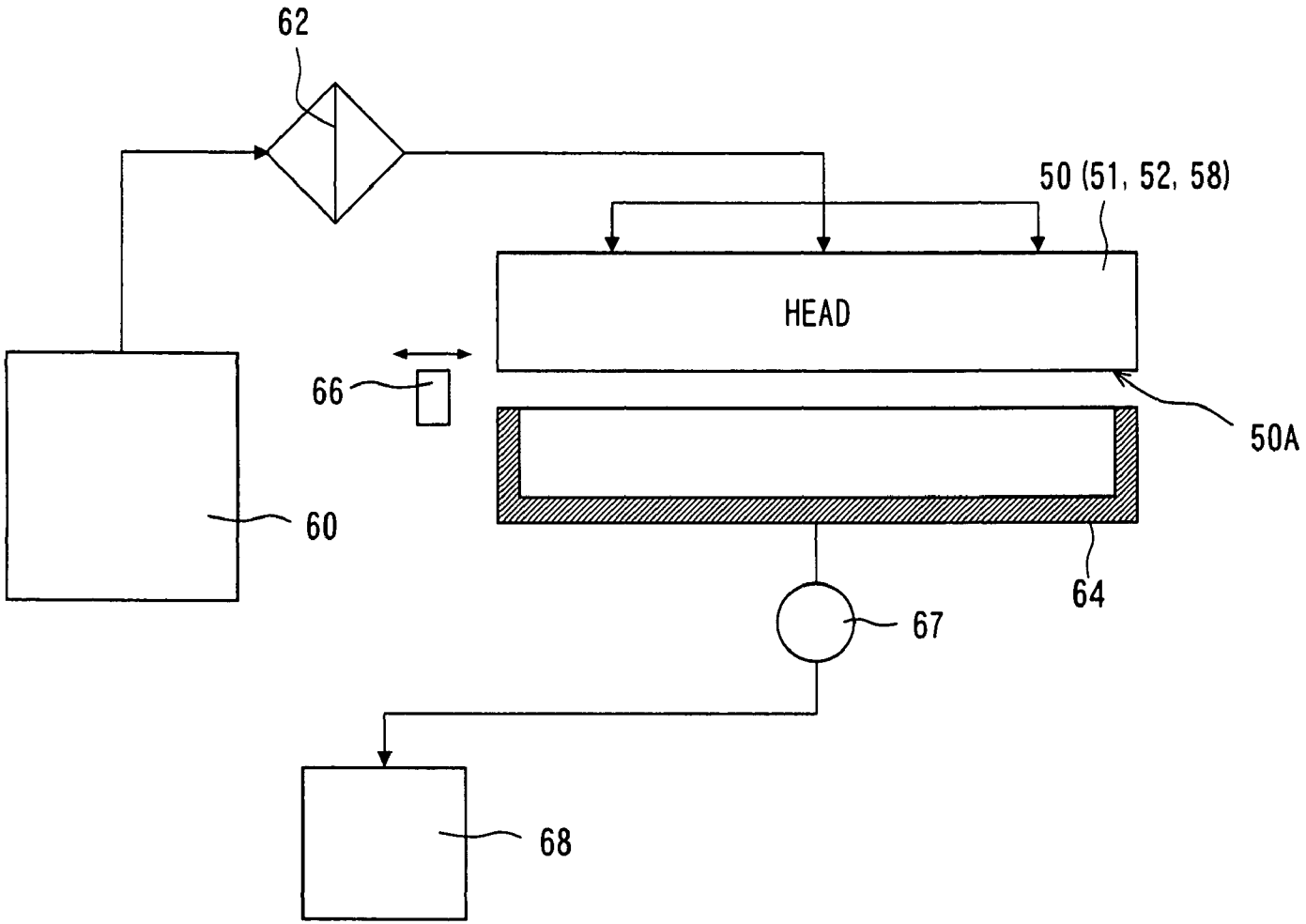
FIG. 2 is an approximate diagram showing the composition of an ink supply system in the inkjet recording apparatus according to the first embodiment.

FIG. 2 is a conceptual diagram showing the composition of an ink supply system in the inkjet recording apparatus 10. As described later in details, the head 50 comprises: a plurality of nozzles 51; pressure chambers 52 connected respectively to the nozzles 51; and piezoelectric elements 58 corresponding respectively to the pressure chambers 52. The ink inside the pressure chambers 52 is pressurized by driving the piezoelectric elements 58, thereby causing ink droplets to be ejected from the nozzles 51 connected to the pressure chambers 52 (see FIGS. 3 and 4).

In FIG. 2, the ink tank 60 is a base tank that supplies ink to the head 50 and is set in the ink storing and loading unit 14 described with reference to FIG. 1. The types of the ink tank 60 include a refillable type and a cartridge type. When the remaining amount of ink is low, the ink tank 60 of the refillable type is filled with ink through a filling port (not shown), and the ink tank 60 of the cartridge type is replaced with a new one. From a viewpoint of changing the ink type in accordance with the intended application, the cartridge type is suitable. It is preferable to represent the ink type information with a bar code or the like on the cartridge, and to perform ejection control in accordance with the ink type. The ink tank 60 in FIG. 2 is equivalent to the ink storing and loading unit 14 in FIG. 1 described above.

A filter 62 for removing foreign matters and bubbles is disposed between the ink tank 60 and the head 50 as shown in FIG. 2. The filter mesh size in the filter 62 is preferably equivalent to or not greater than the diameter of the nozzles and commonly approximately 20 μm. Although not shown in FIG. 2, it is preferable to provide a sub-tank integrally to the print head 50 or nearby the head 50. The sub-tank has a damper function for preventing variation in the internal pressure of the head 50 and a function for improving refilling of the print head.

The inkjet recording apparatus 10 is also provided with a cap 64 as a device to prevent drying of ink and an increase in the ink viscosity in the vicinity of the nozzles, and a cleaning blade 66 as a device to clean the nozzle face 50A of the head 50. A maintenance unit including the cap 64 and the cleaning blade 66 can be moved relatively with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when the inkjet recording apparatus 10 is in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the nozzle surface 50A of the head 50 by means of a blade movement mechanism (not shown). If ink droplets or foreign matter are adhering to the nozzle surface 50A, then the cleaning blade 66 slides over the nozzle surface 50A and thereby wipes away the ink droplets, and the like.

During printing or standby, if the operation frequency of specific nozzles 51 is reduced and ink viscosity increases in the vicinity of the nozzles, then a preliminary discharge toward the cap 64 is implemented in order to eject the degraded ink.

Also, when bubbles have entered the ink inside the head 50 (inside the pressure chamber 52), the cap 64 is placed on the head 50, the ink (the ink in which bubbles have immixed) inside the head 50 is removed by suction with a suction pump 67, and the suction-removed ink is sent to a collection tank 68. This suction operation is implemented also when ink is initially loaded into the head 50, or when ink is used after the ink ejection has not been carried out for a long period of time, thereby suctioning degraded ink having increased viscosity (including hardened ink).

When a state in which ink is not ejected from the print head 50 continues for a certain amount of time or longer, the ink solvent in the vicinity of the nozzles evaporates and the ink viscosity increases. In such a state, ink can no longer be ejected from the nozzles 51 even if the piezoelectric elements 58 are driven. Therefore, before reaching such a state (i.e., in a viscosity range that allows ink ejection by driving the piezoelectric elements 58), the piezoelectric elements 58 are driven and the ink is ejected toward an ink receptacle, and a preliminary ejection is performed which causes the ink having an increased viscosity in the vicinity of the nozzles to be ejected. Furthermore, after cleaning away contaminations on a nozzle surface by means of a wiper, such as a cleaning blade 66, provided as a cleaning device for the nozzle surface, a preliminary ejection is also carried out in order to prevent infiltration of foreign matter into nozzles caused by such a wiping action of the wiper. The preliminary ejection is also referred to as "dummy ejection", "purge", "expectoration", and so on.

When bubbles have entered a nozzle 51 or a pressure chamber 52, or when the ink viscosity in the vicinity of a nozzle has exceeded a certain level, the ink can no longer be ejected by the preliminary discharge, and hence a suctioning action is carried out as follows.

More specifically, when bubbles have immixed in the ink inside a nozzle 51 and a pressure chamber 52, and when the ink viscosity in the vicinity of a nozzle has gone over a certain level, ink can no longer be ejected from the nozzle even if the piezoelectric element 58 is operated. In these cases, the cap 64 as a suctioning device to remove the ink inside the pressure chamber 52 by suctioning it with a suction pump, or the like, is placed on the nozzle face 50A of the head 50. The present embodiment of the invention is characterized in that this suction operation is performed for each of the nozzle groups which includes one nozzle 51 or a plurality of nozzles 51, and wasteful consumption of ink can thus be reduced.

Figure 3:
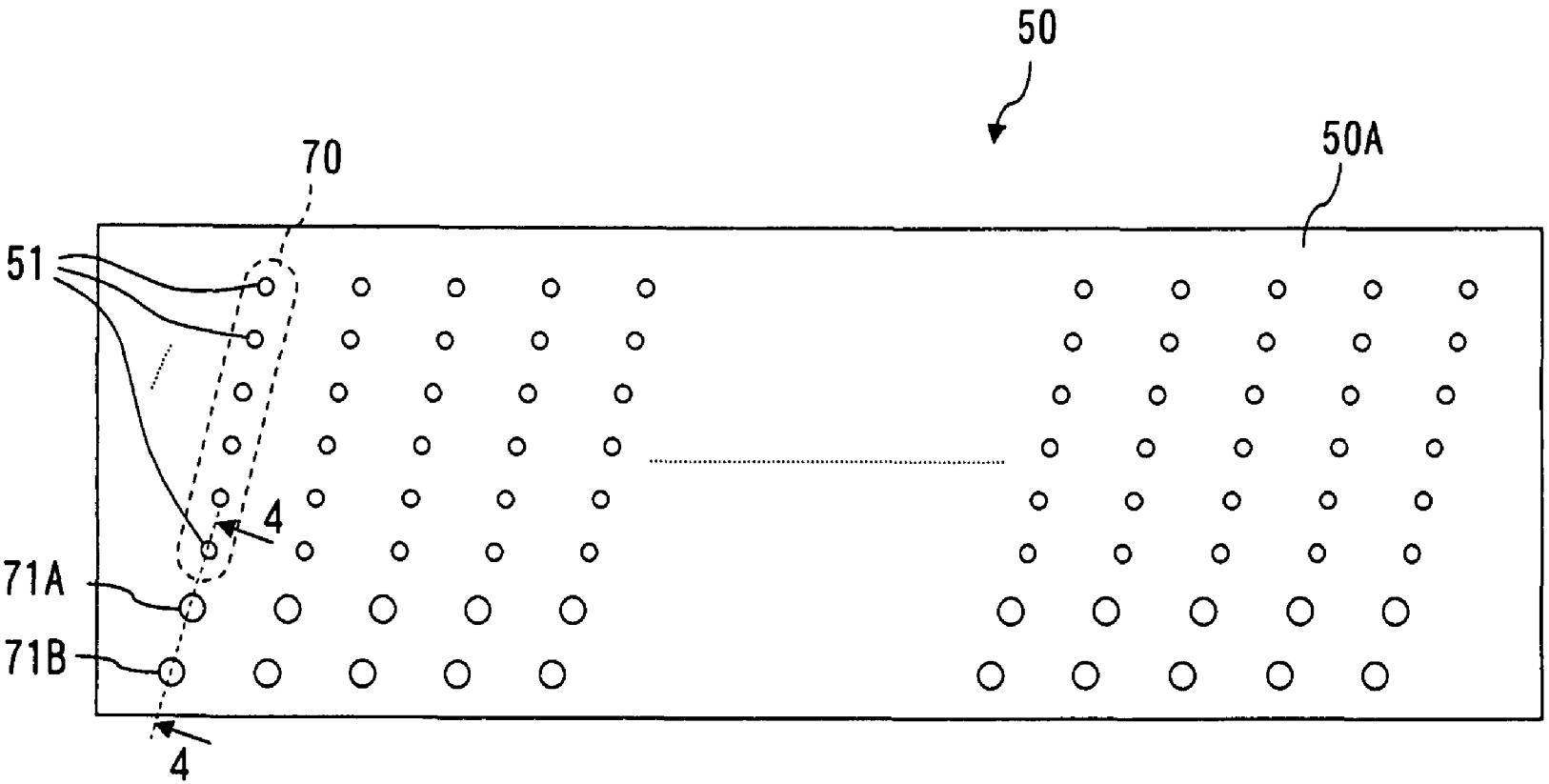
FIG. 3 is a plan diagram showing a nozzle surface of a head according to the first embodiment.

Next, the composition of the head 50 is described below. FIG. 3 is a plan diagram showing the nozzle surface 50A of the head 50. As described above, the head 50 according to the present embodiment is a full line type of head having a length corresponding to the maximum paper width, and the lengthwise direction of the head 50 corresponds to the breadthways direction (main scanning direction) of the recording paper 16 (see FIG. 1).

A plurality of nozzles 51 are provided on the nozzle surface 50A of the head 50 in a two-dimensional (matrix) configuration. More specifically, a plurality of nozzle columns 70, each comprising a plurality of nozzles 51 arranged in an oblique, non-perpendicular direction with respect to the lengthwise direction of the nozzle surface 50A, are provided in the lengthwise direction. Although not shown specifically in the diagrams, in the projected nozzle row obtained by projecting the nozzles to be in alignment in the lengthwise direction, the nozzles are arranged at a uniform nozzle pitch which yields a substantial high density of the effective dot pitch. In each of the heads of the other embodiments described later (the second to the ninth embodiments), nozzle rows 70 of this kind are also provided in a similar fashion.

Two suction holes 71A and 71B are provided in each of the nozzle columns 70. The suction holes 71A and 71B are composed so as to have a slightly larger hole diameter than the nozzles 51. In the present embodiment, ink suctioning is carried out selectively for each nozzle column 70, through these suctioning holes 71A and 71B.

Figure 4:
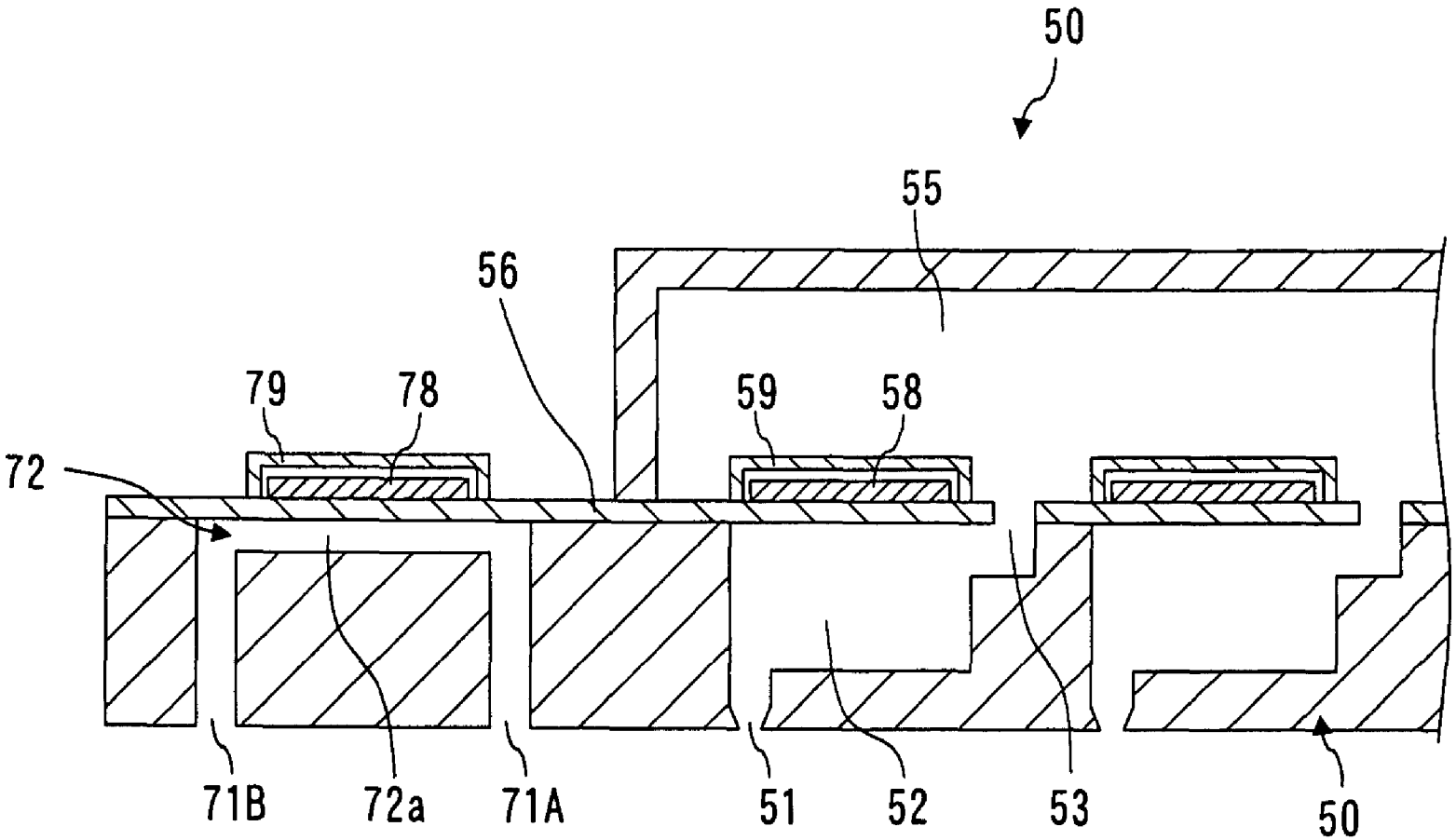
FIG. 4 is a cross-sectional side view showing one portion of the head according to the first embodiment.

FIG. 4 is a cross-sectional side view showing one portion of the head 50 (a cross-sectional diagram along line 4-4 in FIG. 3), and the portion comprising a nozzle column 70 and the suction holes 71A and 71B corresponding to the nozzle column 70 is depicted in FIG. 4. As shown in FIG. 4, a pressure chamber 52 and a piezoelectric elements 58 (corresponding to the first piezoelectric elements), and the like, are provided for each of the nozzles 51, inside the head 50. The pressure chambers 52 are connected respectively to the nozzles 51. Moreover, one wall surface (the upper wall surface) of each of the pressure chambers 52 is constituted by a diaphragm 56, and a common flow channel 55 is provided over the diaphragm 56 in a position corresponding to the region where the pressure chambers 52 are formed. The common flow channel 55 is connected to the pressure chambers 52 via individual flow channels 53 provided for the pressure chambers 52 respectively. The ink supplied from the ink tank 60 in FIG. 2 is stored in the common flow channel 55, and the ink inside the common flow channel 55 is distributed and supplied to each of the pressure chambers 52 through the individual flow channels 53.

The piezoelectric elements 58 are provided on the diaphragm 56 (on the same side as the common flow channel 55, of the diaphragm 56) at positions corresponding to the respective pressure chambers 52, and protective members 59 for protecting the respective piezoelectric elements 58 are provided in order to prevent the piezoelectric elements 58 from being exposed to the ink inside the common flow channel 55. The piezoelectric elements 58 each have a structure in which a drive electrode (individual electrode) is provided on the surface of a thin film-shaped piezoelectric body. The diaphragm 56 is constituted by a conductive member made of stainless steel, or the like, and it also serves as a common electrode for the piezoelectric elements 58.

By adopting the structure of this kind, when a drive voltage is applied to the drive electrode of a piezoelectric element 58, the ink inside the pressure chamber 52 is pressurized in accordance with the displacement of the piezoelectric element 58, and an ink droplet is ejected from the nozzle 51 connected to the pressure chamber 52.

As described above, suction holes 71A and 71B are provided for each of the nozzle columns 70 (see FIG. 3). As shown in FIG. 4, the suction holes 71A and 71B are connected through a flow channel 72 (corresponding to a connection path) provided inside the head 50. The diaphragm 56 serves as one wall surface (the upper wall surface) of the horizontal flow channel 72*a* constituting one portion of the flow channel 72, and a piezoelectric element 78 (corresponding to a second piezoelectric element) and a protective member 79 are provided on top of the diaphragm 56 at a position corresponding to the horizontal flow channel 72*a*. The compositions of the piezoelectric element 78 and the protective member 79 are respectively similar to the compositions of the piezoelectric element 58 and the protective member 59, and hence description thereof is omitted here.

Figure 5A:
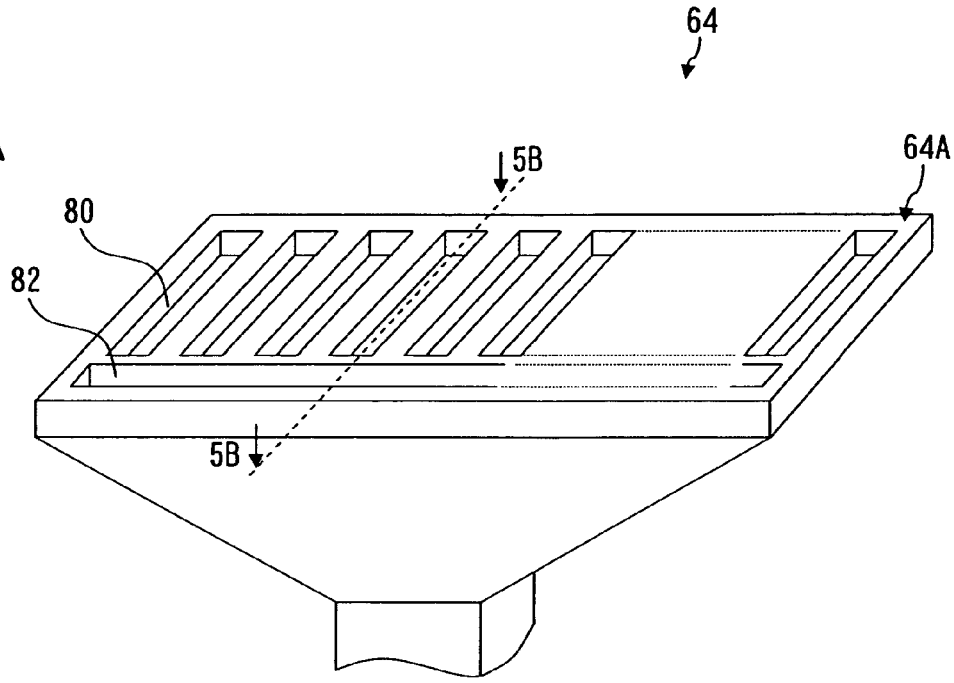
FIGS. 5A and 5B are an oblique external view and a cross-sectional side view of a cap according to the first embodiment, respectively.
Figure 5B:
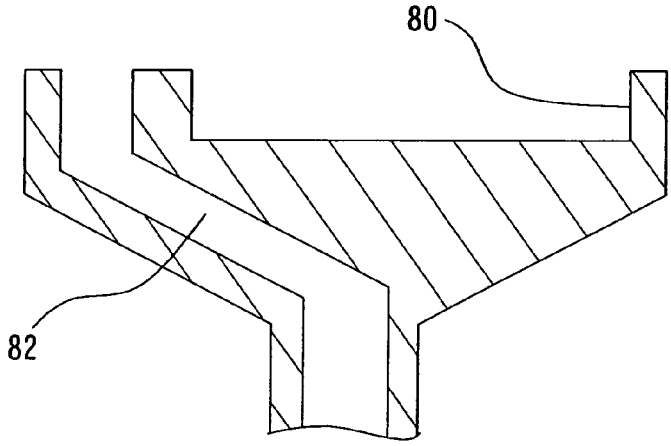

FIGS. 5A and 5B are diagrams showing the composition of the cap 64; FIG. 5A is an external oblique view of the cap 64 and FIG. 5B is a cross-sectional side view of the cap 64 (a cross-sectional diagram along line 5B-5B in FIG. 5A).

First flow channels 80 and a second flow channel 82 are provided in the cap 64. The first flow channels 80 are thin, bottomed grooves which are open on the side of the surface (abutting surface 64A) of the cap 64, and a plurality of first flow channels 80 are arranged following the lengthwise direction of the abutting surface 64A so as to correspond to the respective nozzle columns 70 in FIG. 3. One end of the second flow channel 82 is open in a long and narrow shape following the direction of arrangement of the first flow channels 80 (in other words, the lengthwise direction of the abutting surface 64A), and the other end thereof is connected to a suctioning pump 67 (although not shown in FIGS. 5A and 5B, the suctioning pump 67 is shown in FIG. 2).

Figure 6A:
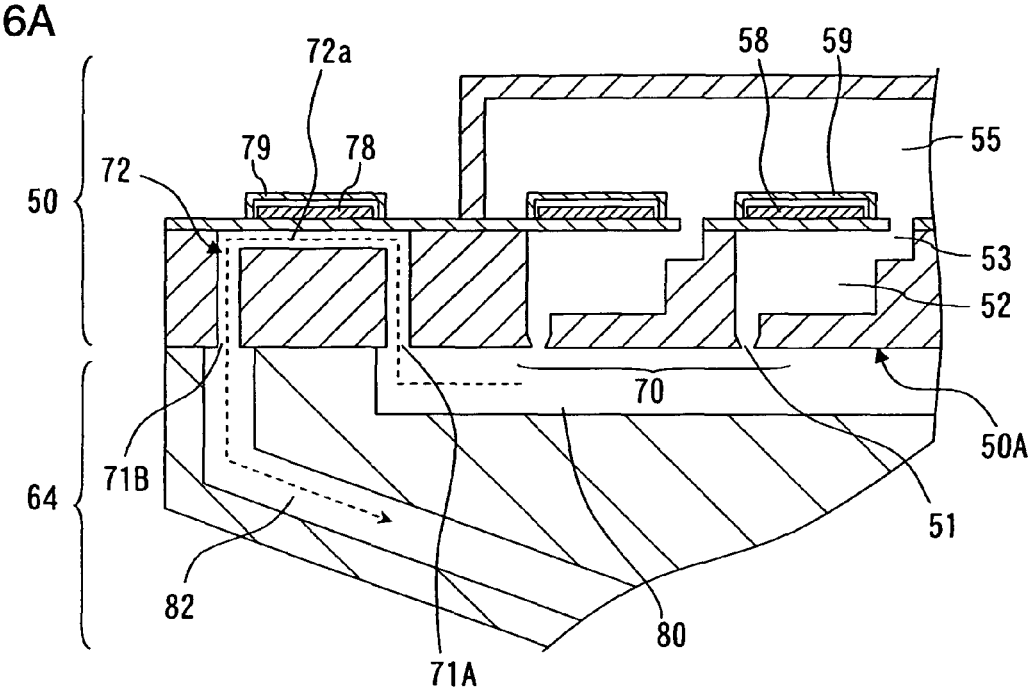
FIGS. 6A and 6B are side views showing a state where the cap is abutted on the nozzle surface of the head.
Figure 6B:
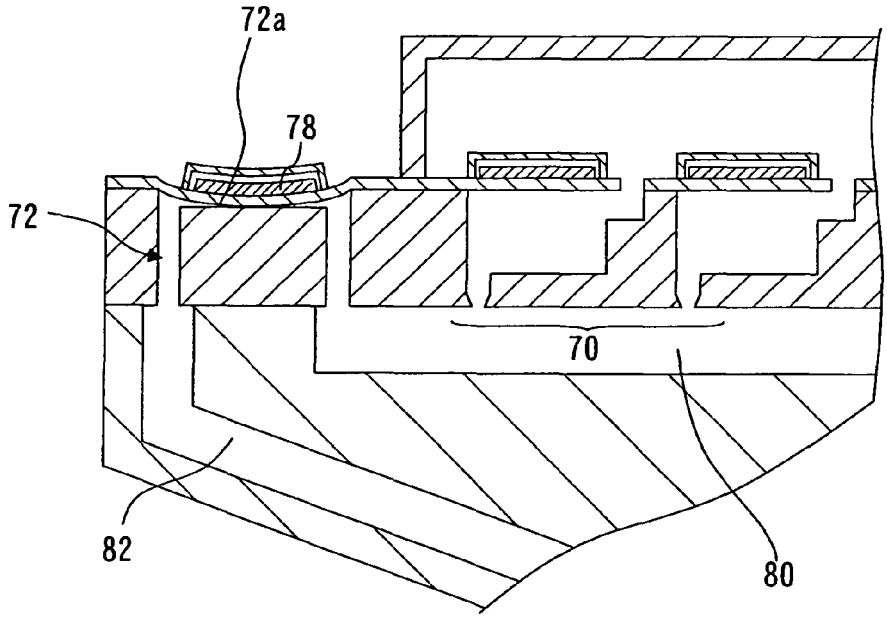

FIGS. 6A and 6B are cross-sectional side views showing a state where the cap 64 comes in contact with the nozzle surface 50A of the head 50; FIG. 6A is a diagram showing a state while the ink is being suctioned, and FIG. 6B is a diagram showing a state while the ink is not being suctioned. As shown in FIGS. 6A and 6B, in a state where the cap 64 has come in contact with the head 50, the nozzles 51 of each of the nozzle columns 70 corresponding to the first flow channel 80 and the suction hole 71A corresponding to the nozzle column 70 are arranged so as to overlap with the opening part of the corresponding first flow channel 80. On the other hand, the suction hole 71B corresponding to the nozzle column 70 is arranged so as to overlap with the opening part of the second flow channel 82.

When the ink is to be suctioned, as shown in FIG. 6A, the piezoelectric element 78 corresponding to the nozzle column 70 is not driven, and the horizontal flow channel 72*a* is hence in an open state. In other words, the first flow channel 80 and the second flow channel 82 are in a connected state. Thus, when the suction pump 67 is operated (see FIG. 2), ink suctioning is performed for that nozzle column 70.

On the other hand, when ink is not to be suctioned, then as shown in FIG. 6B, the piezoelectric element 78 corresponding to the nozzle column 70 is driven, and the horizontal flow channel 72*a* is partially in a closed state. In other words, the first flow channel 80 is not connected with the second flow channel 82. Therefore, even if the suction pump 67 is operated, ink suctioning is not carried out with respect to that nozzle column 70.

According to the first embodiment of the invention, a horizontal flow channel 72*a* constitutes one portion of a flow channel 72 of the head 50 which connects each first flow channel 80 and the second flow channel 82 of the cap 64, and in a state where the cap 64 is in contact with the nozzle surface 50A of the head 50, the horizontal flow channel 72*a* can be partially opened or closed by means of a piezoelectric element 78 provided on one wall surface (the diaphragm 56) of the horizontal flow channel 72*a*. Since it is thus possible to carry out ink suctioning selectively, with respect to each individual nozzle column 70, then wasteful ink consumption can be lowered and the structure of the cap 64 can be simplified, and hence the overall manufacturing costs can be reduced. Furthermore, by adopting a common structure for the piezoelectric elements 58 for driving ejection and the piezoelectric elements 78 for suctioning ink, it is possible to simplify steps for manufacturing the head 50, and it is also possible to reduce the manufacturing costs more effectively.

Although, in the first embodiment, a piezoelectric element 78 which functions as a valve device is disposed to the outer side of one end of each nozzle column 70 (see FIG. 3), a mode may also be adopted in which each piezoelectric element 78 is disposed in the center of each nozzle column 70 or on the outer side of both ends of each nozzle column 70. In the case of a mode where the piezoelectric elements 78 are disposed in the center of the nozzle columns 70, ink suctioning is carried out uniformly with respect to each nozzle column 70.

Moreover, by controlling a drive voltage applied to a piezoelectric element 78, it is possible to change the amount of displacement of the piezoelectric element 78, and therefore the open/closed state of the horizontal flow channels 72*a* can be changed in steps. Hence, it is possible to change the ink suction volume individually for each nozzle column 70, and therefore wasteful ink consumption can be reduced yet further.

Although, in the first embodiment, a mode is adopted in which ink suctioning is carried out selectively for each of the nozzle columns 70, but it is also possible to carry out pressurization selectively for each of the nozzle columns 70 in a similar fashion. Furthermore, it is also possible to divide the nozzles into desired nozzle groups each comprising one or a plurality of nozzles 51 and carry out ink suctioning or pressurization selectively with respect to each nozzle group. The nozzle arrangement composition is not limited to the embodiment shown in FIG. 3. Furthermore, the mode is not limited to one in which the common flow channel 55 is disposed across the diaphragm 56 from the pressure chambers 52, and a mode is also possible in which the common flow channel 55 is disposed on the same side of the diaphragm 56 as the pressure chambers 52. Moreover, there is also a mode in which the size of the piezoelectric elements 78 is adjusted in such a manner that they produce a larger displacement than the piezoelectric elements 58. There is also a mode in which a normal valve (for example, an electromagnetic valve) is used instead of each piezoelectric element 78. These techniques can be also applied to the further embodiments described later (the second to ninth embodiments) in a similar fashion.

Second Embodiment

FIGS. 7A to 7D are diagrams showing a second embodiment of the present invention, and they are cross-sectional side views showing a state where a cap 164 is in contact with the nozzle surface 150A of a head 150. First flow channels 80 and a second flow channel 82 similar to those of the cap 64 of the first embodiment are provided in the cap 164. In FIGS. 7A to 7D, items which are the same as or similar to those in FIGS. 6A and 6B are labeled with the same reference numerals, and description thereof is omitted here.

Figure 7A:
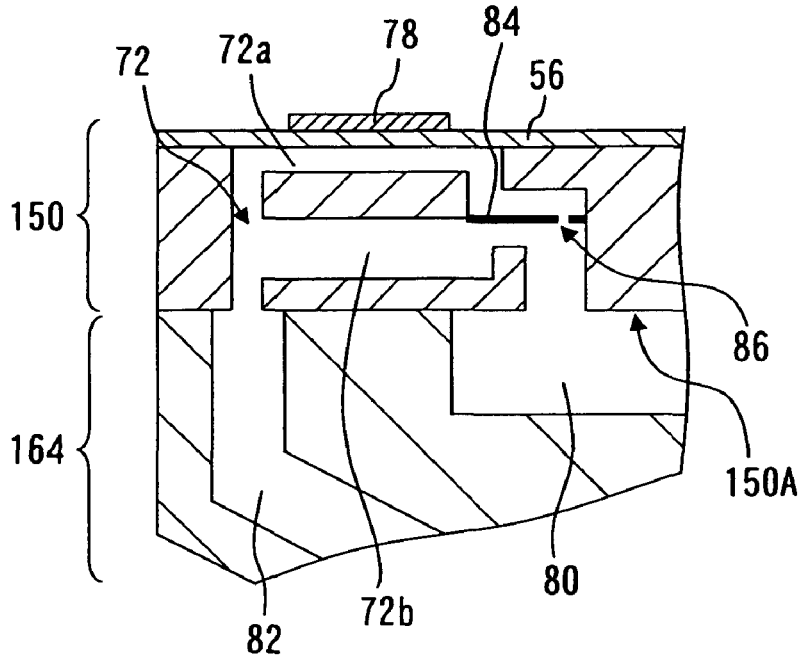
FIGS. 7A to 7D are cross-sectional side views showing a head and a cap according to a second embodiment.

In the second embodiment, as shown in FIG. 7A, the flow channel 72 of the head 150 branches into two horizontal flow channels 72*a* and 72*b* (i.e., a first horizontal flow channel 72*a* and a second horizontal flow channel 72*b*), and a diaphragm film (partition film) 84 is provided in the branch part on the first flow channel 80 side. The diaphragm film 84 is arranged in parallel with the nozzle surface of the head 150 and a hole section 86 having a small diameter is provided in the diaphragm film 84 so as to pierce the diaphragm film 84.

Figure 7B:
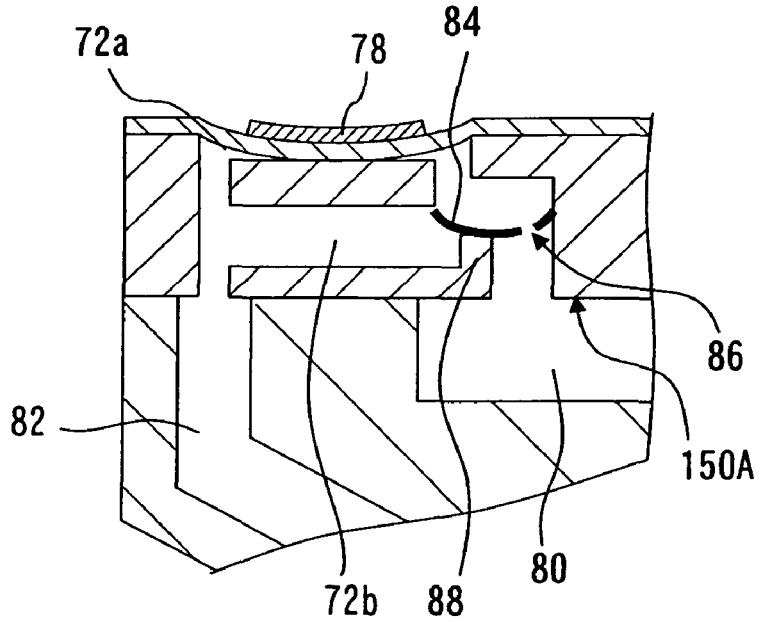

When the ink is not to be suctioned, as shown in FIG. 7B, the piezoelectric element 78 is driven and a part of the first horizontal flow channel 72*a* is in a closed state. In this, since the second flow channel 82 side has a negative pressure due to the operation of the suction pump 67, then as shown in FIG. 7B, the diaphragm film 84 makes contact with the flow channel partition 88 provided on the nozzle surface 150A side, and hence the second flow channel 72*b* is partially in a closed state. Thus, the first flow channel 80 is not connected with the second flow channel 82, and ink suctioning is not carried out with respect to a nozzle column 70 (not shown) corresponding to the first flow channel 80.

Figure 7C:
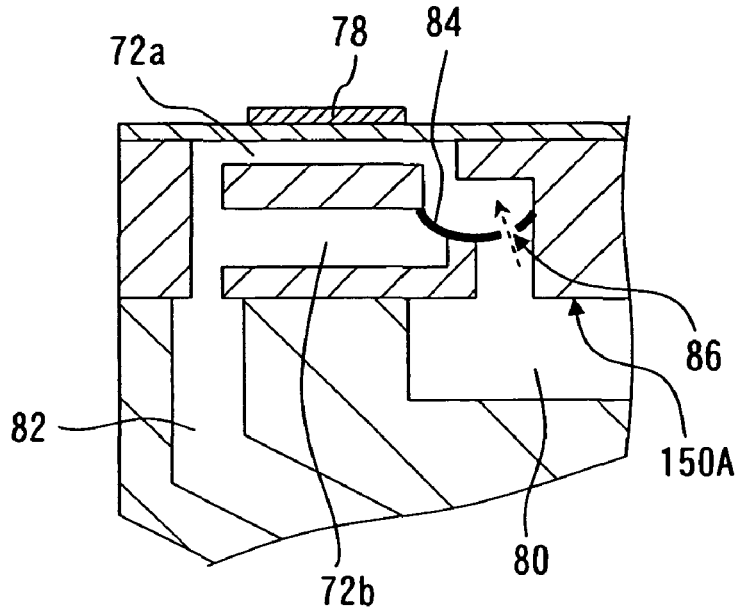
Figure 7D:
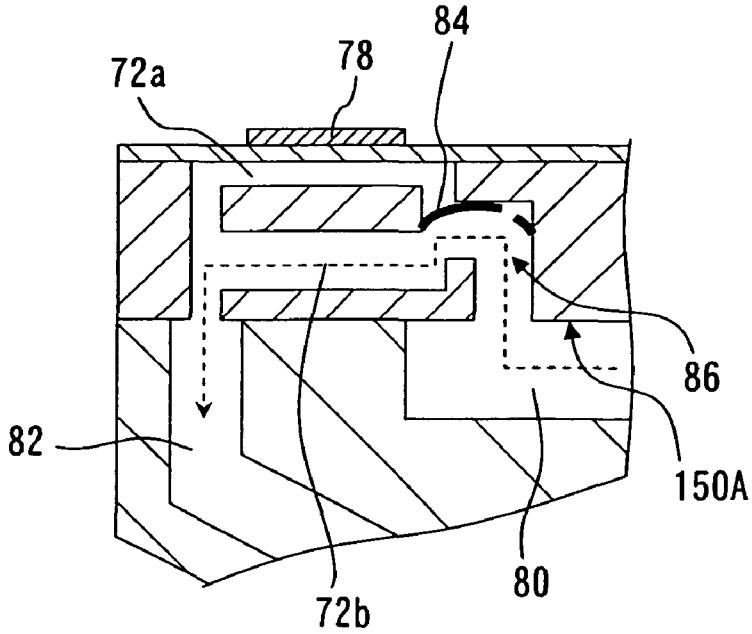

On the other hand, when the ink is to be suctioned, as shown in FIG. 7C, the piezoelectric element 78 is not driven and the first horizontal flow channel 72*a* is in an open state. In this case, as denoted with the dotted arrow in FIG. 7C, the ink flows through the hole section 86 in the diaphragm film 84, from the first flow channel 80 to the side of the first horizontal flow channel 72*a*, and due to the pressure differential between the two sides of the diaphragm film 84, as shown in FIG. 7D, the diaphragm film 84 is deformed and pulled upward toward the opposite side from the nozzle surface 150A (namely, toward the diaphragm 56), while the second horizontal flow channel 72*b* is in an open state. Consequently, the first flow channel 80 is connected with the second flow channel 82, and the ink inside a nozzle column 70 (not shown) corresponding to that first flow channel 80 is suctioned through the route denoted by the dotted arrow in FIG. 7D.

According to the second embodiment, since a diaphragm film 84 is displaced in conjunction with the driving of the corresponding piezoelectric element 78 (i.e., the displacement of the corresponding piezoelectric element 78), then it is possible to carry out ink suctioning selectively for each nozzle column 70, and therefore wasteful ink consumption can be reduced. Furthermore, since the displacement of each piezoelectric element 78 can be increased (amplified) by using a diaphragm film 84, then it is possible to reduce the size of each piezoelectric element 78 and a first horizontal flow channel 72*a* corresponding to each piezoelectric element 78, in comparison with the first embodiment.

Third Embodiment

Figure 8:
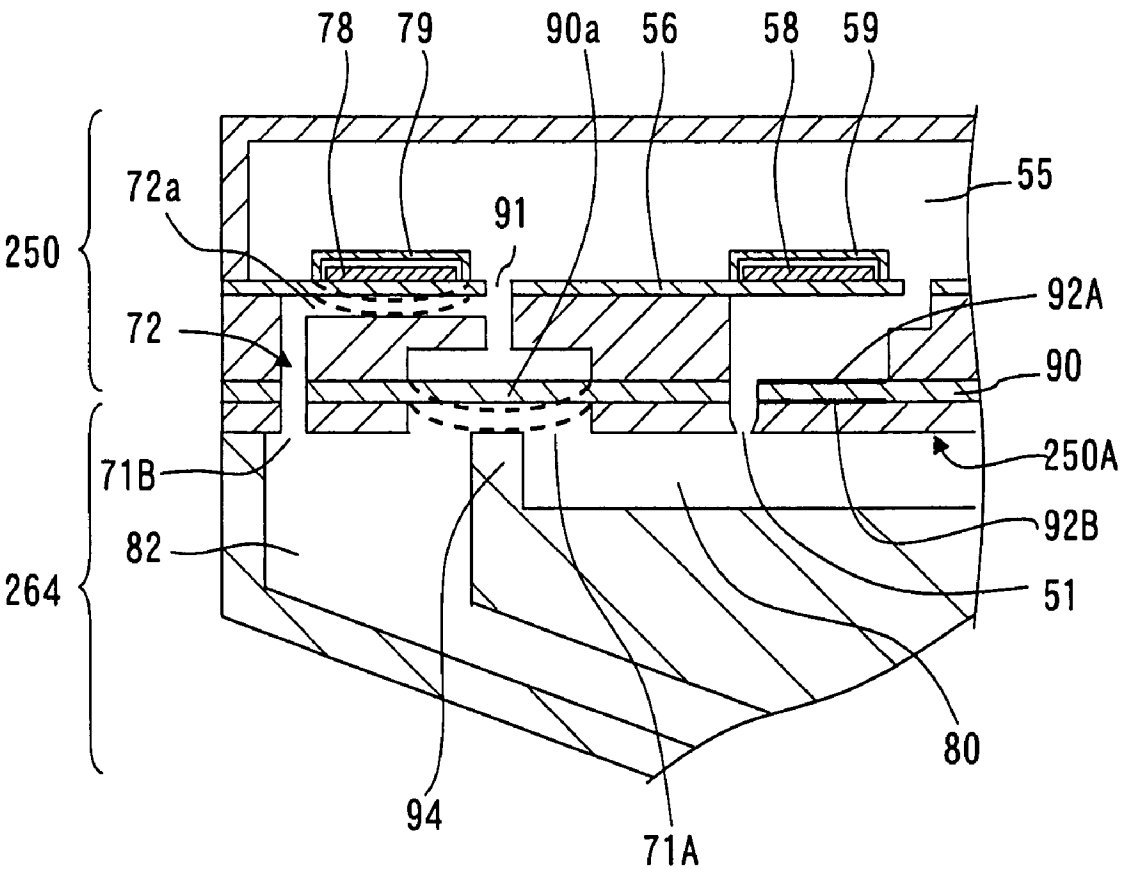
FIG. 8 is a cross-sectional side view showing a head and a cap according to a third embodiment.

FIG. 8 is a diagram showing a third embodiment of the present invention, and it is a cross-sectional side view showing a state where a cap 264 is in contact with the nozzle surface 250A of a head 250. First flow channels 80 and a second flow channel 82 similar to those of the cap 64 of the first embodiment are provided in the cap 264. In FIG. 8, items which are the same as or similar to those in FIGS. 6A to 7D are labeled with the same reference numerals, and description thereof is omitted here.

The third embodiment is one in which a PVDF (polyvinylidene difluoride) film 90 is provided as an intermediate layer between the nozzle surface of the head 250 and the pressure chambers 52. Electrodes (gold electrodes) 92A, 92B are provided on the front and rear surfaces of the PVDF film 90 at positions corresponding to the pressure chambers 52, and thus a portion of the PVDF film 90 forms a pressure determination sensor (ejection failure determination device) for determining ejection defects occurring as a result of an air bubble, or the like, having infiltrated into each pressure chamber 52. Each suction hole 71A is formed to have a broader width than each suction hole 71B, and a portion of each PVDF film 90 is exposed inside the suction hole 71A (hereinafter, this exposed portion is also called the "coupling film 90*a*"). Furthermore, a PI (i.e., polyimide) insulating film (not shown in the diagrams) is provided on each of the front and rear surfaces of the PVDF film 90 (including the electrodes 92A and 92B).

In a state where a cap 264 is in contact with the nozzle surface 250A of the head 250, a partition 94 between the first flow channel 80 and the second flow channel 82 of the cap 264 is disposed in a position corresponding substantially to the center of the suction hole 71A of the head 250. Furthermore, a connection port 91 which connects to the common flow channel 55 is provided at one end of the flow channel 72, in such a manner that the ink flows into the flow channel 72 from the common flow channel 55.

When the ink is to be suctioned, the piezoelectric element 78 is not driven, and the first flow channel 80 is connected with the second flow channel 82 through the gap (space) between the coupling film 90*a* and the partition 94. Therefore, when the suction pump 67 is operated, the ink is suctioned from the nozzle column 70 (not shown) corresponding to the first flow channel 80.

On the other hand, when the ink is not to be suctioned, as shown by a broken line in FIG. 8, the piezoelectric element 78 is driven and a portion of the horizontal flow channel 72*a* is in a closed state. Due to the negative pressure of the second flow channel 82, the coupling film 90*a* deforms toward the nozzle surface and makes contact with the partition 94, and hence the first flow channel 80 is disconnected from the second flow channel 82. Therefore, even if the suction pump 67 (not shown) is operated, the ink in a nozzle column 70 (not shown) corresponding to the first flow channel 80 is not suctioned.

According to the third embodiment, similarly to the second embodiment, ink suctioning is carried out selectively for each nozzle column 70, by means of the coupling films 90*a* being displaced in conjunction with the driving of the piezoelectric elements 78. In particular, by carrying out ink suctioning in accordance with the determination results of the pressure determination sensors, it is possible to reduce wasteful consumption of ink yet further. Moreover, by using a portion of each PVDF film 90 which constitutes a pressure determination sensor as a coupling film 90*a*, it is possible to suppress the cost of manufacturing the head 250.

Moreover, there is also a mode in which a coupling film is formed by another member, rather than of a portion of a PVDF film 90 constituting a pressure determination sensor. Furthermore, it is also possible to form each coupling film 90*a* having a broad width in order to increase the amount of displacement of each coupling film 90*a*.

Although the third embodiment adopts a mode where a piezoelectric element 78 is disposed inside the common flow channel 55, it is also possible to adopt a mode in which a piezoelectric element 78 is disposed outside the common flow channel 55, as shown in the first embodiment (see FIG. 4).

Fourth Embodiment

Figure 9:
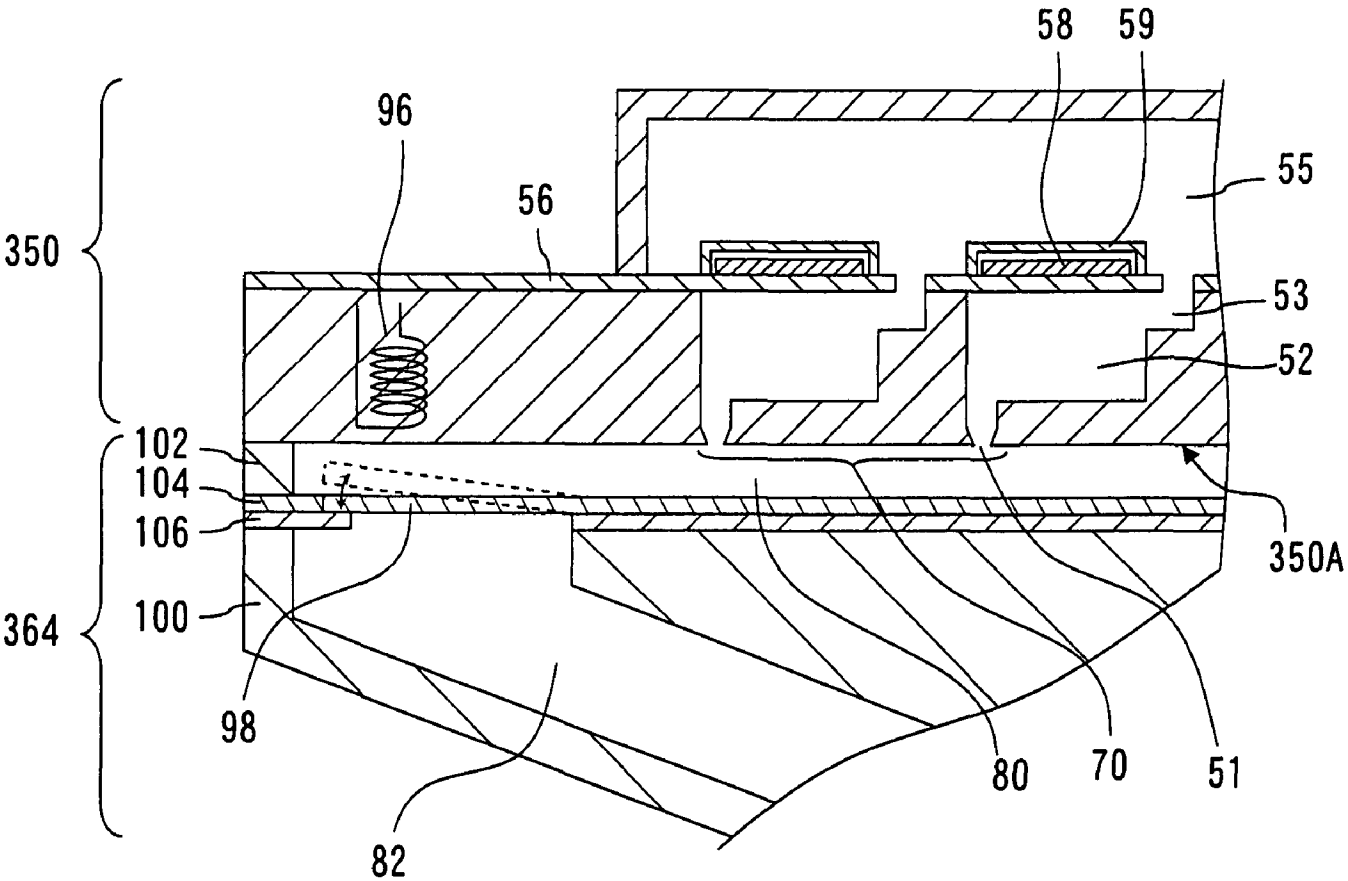
FIG. 9 is a cross-sectional side view showing a head and a cap according to a fourth embodiment.
Figure 10:
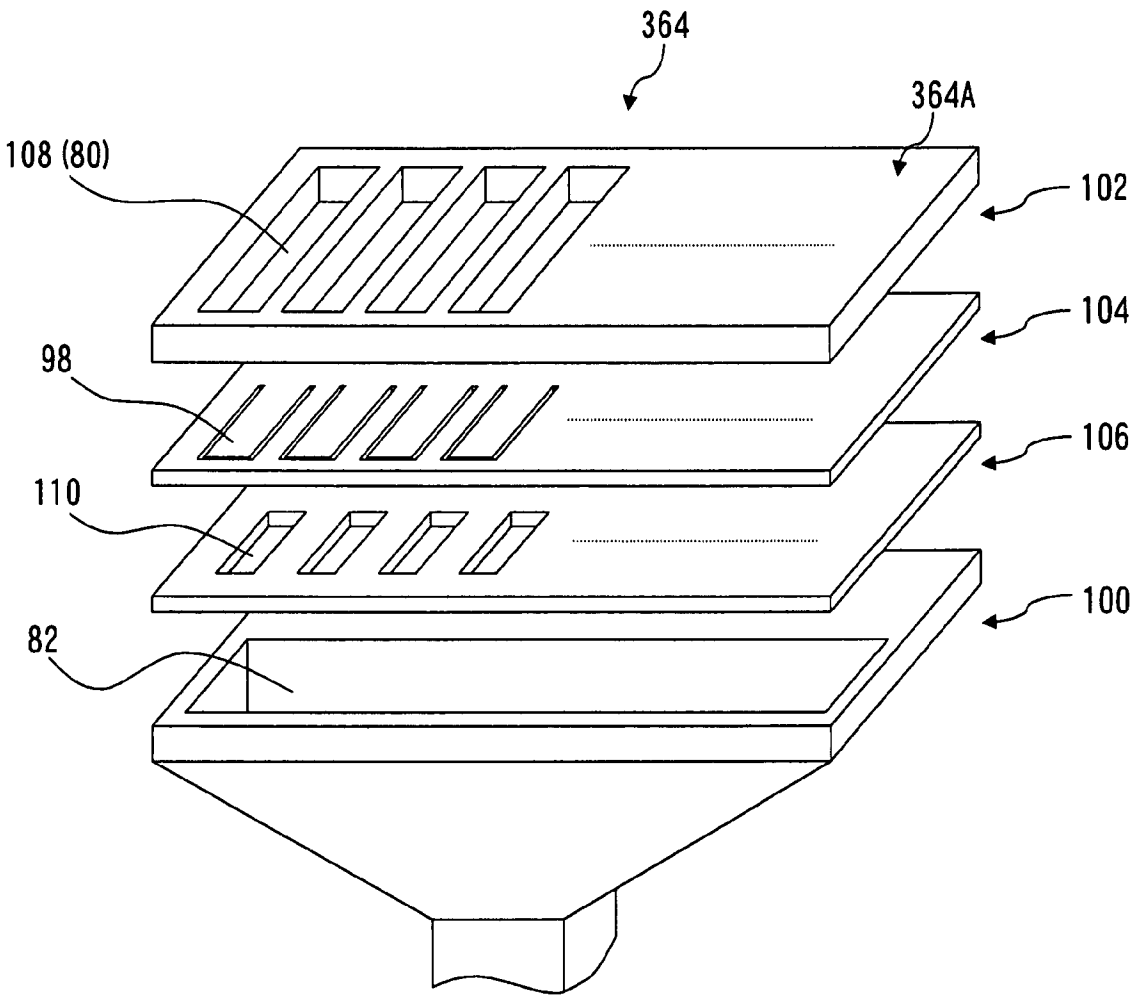
FIG. 10 is an exploded oblique view of the cap according to the fourth embodiment.

FIG. 9 is a diagram showing a fourth embodiment of the present invention, and it is a cross-sectional side view showing a state where a cap 364 is in contact with the nozzle surface 350A of a head 350. FIG. 10 is an exploded oblique view of the cap 364. In FIGS. 9 and 10, items which are the same as or similar to those in FIGS. 6A to 8 are labeled with the same reference numerals, and description thereof is omitted here.

According to the fourth embodiment, valve sections 98 in the cap 364 partially opens and closes the flow channels (80, 82) for suctioning ink, by means of electromagnets 96 provided in the head 350. Similarly to the piezoelectric elements 78 in the first to third embodiments, each electromagnet 96 is provided for each nozzle column 70 (see FIG. 3) and the surface section of each electromagnet 96 is subjected to an insulating treatment. In FIG. 9, a simplified view of an electromagnet 96 inside the head 350 is shown.

The cap 364 principally includes: first flow channels 80 provided respectively for the nozzle columns 70; and a second flow channel 82 which connects with the first flow channels 80 through the valve sections 98 provided respectively for the first flow channels 80. In a cap 364 of this kind, as shown in FIG. 10, first to third substrates 102, 104 and 106 are overlapped and bonded together on the front surface of the cap main body 100. Hole sections 108 corresponding to first flow channels 80 are formed in the first substrate 102 which constitutes an abutting surface 364A that makes contact with the head 350, and the hole sections 108 are formed in a long and thin shape in the breadthways direction so as to pass through the first substrate 102. A second substrate 104 is formed by a metal plate, and the valve sections 98 are formed so as to correspond to the hole sections 108 respectively, by providing cut lines extending in three directions to the second substrate 104. There is also a mode in which the second substrate 104 is made of resin, and metal is vapor-deposited onto the valve sections 98. Hole sections 110 corresponding to the valve sections 98 are pierced through the third substrate 106. The hole sections 110 in the third substrate are formed to have a smaller size than the valve sections 98 in the second substrate. The valve sections 98 of the cap 364 constituted in this way have a cantilever structure as shown in FIG. 9, and are displaceable only toward the first flow channels 80 because of the third substrate 106.

When the ink is to be suctioned, a prescribed current is applied to the electromagnet 96 (i.e., the electromagnet 96 is turned on), and as shown by the broken line in FIG. 9, the valve section 98 is displaced toward the first flow channel 80, and the first flow channel 80 is connected with the second flow channel 82. Therefore, when the suction pump 67 (not shown) is operated, the ink is suctioned from a nozzle column 70 corresponding to that first flow channel 80.

On the other hand, when the ink is not to be suctioned, current is not applied to the electromagnet 96 (i.e., the electromagnet 96 is turned off), and the valve section 98 is in a state where one end thereof is in contact with the third substrate 106, in other words, the first flow channel 80 is disconnected from the second flow channel 82. Therefore, even if the suction pump (not shown) is operated, the ink in a nozzle column 70 corresponding to that first flow channel 80 is not suctioned.

According to the fourth embodiment, the valve sections 98 of the cap 364 are opened or closed by switching on or off the electromagnets 96 of the head 350, and thereby it is possible to carry out ink suctioning selectively for each nozzle column 70. Consequently, it is possible to reduce wasteful consumption of ink.

Furthermore, according to a method in which the valve sections 98 are displaced by means of the electromagnets 96, it is possible to form the valve sections 98 (i.e., the second substrate 104) to have a relatively thin thickness, and therefore the valve sections 98 can be displaced readily.

Fifth Embodiment

Figure 11:
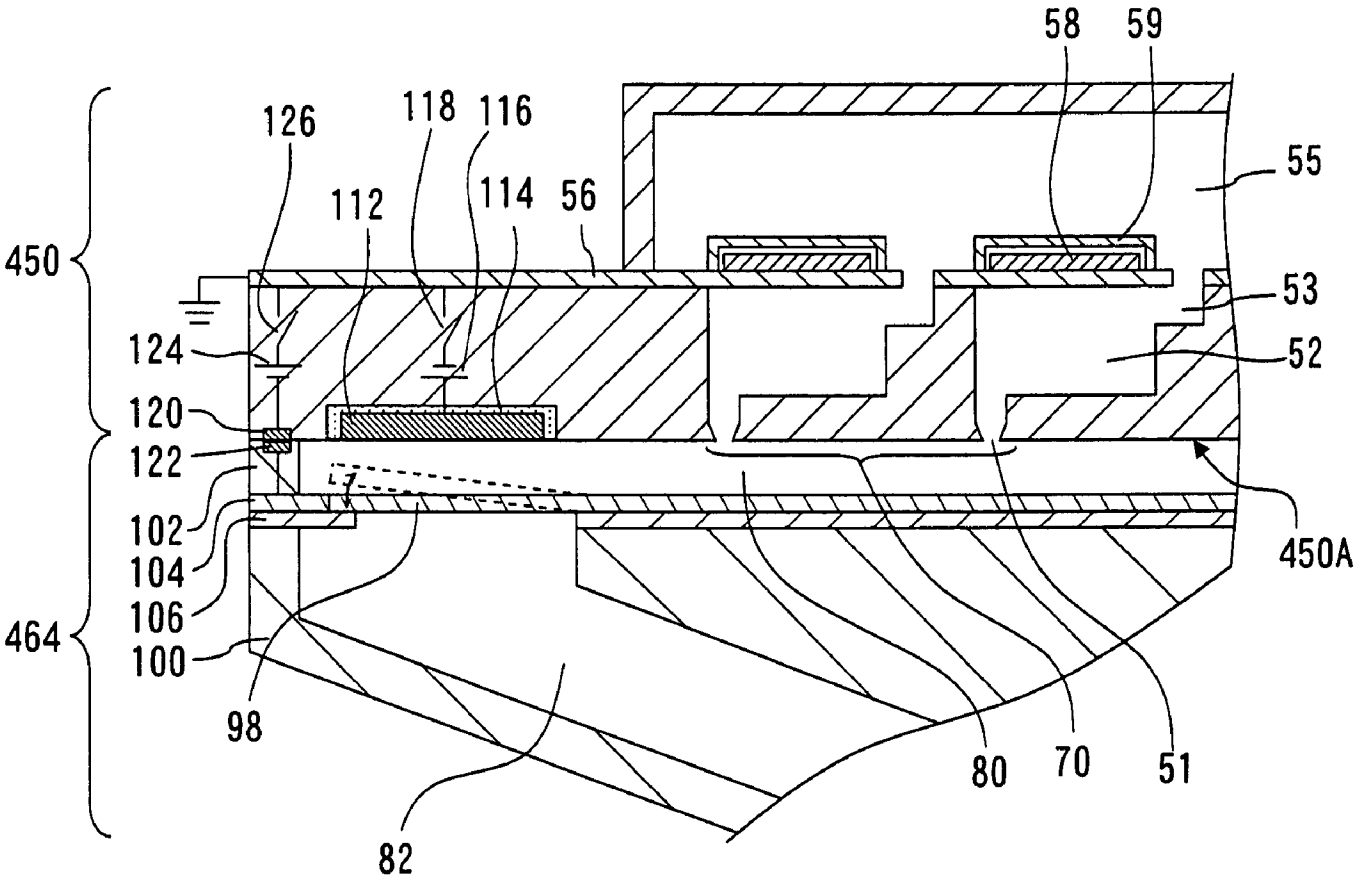
FIG. 11 is a cross-sectional side view showing a head and a cap according to a fifth embodiment.
Figure 12:
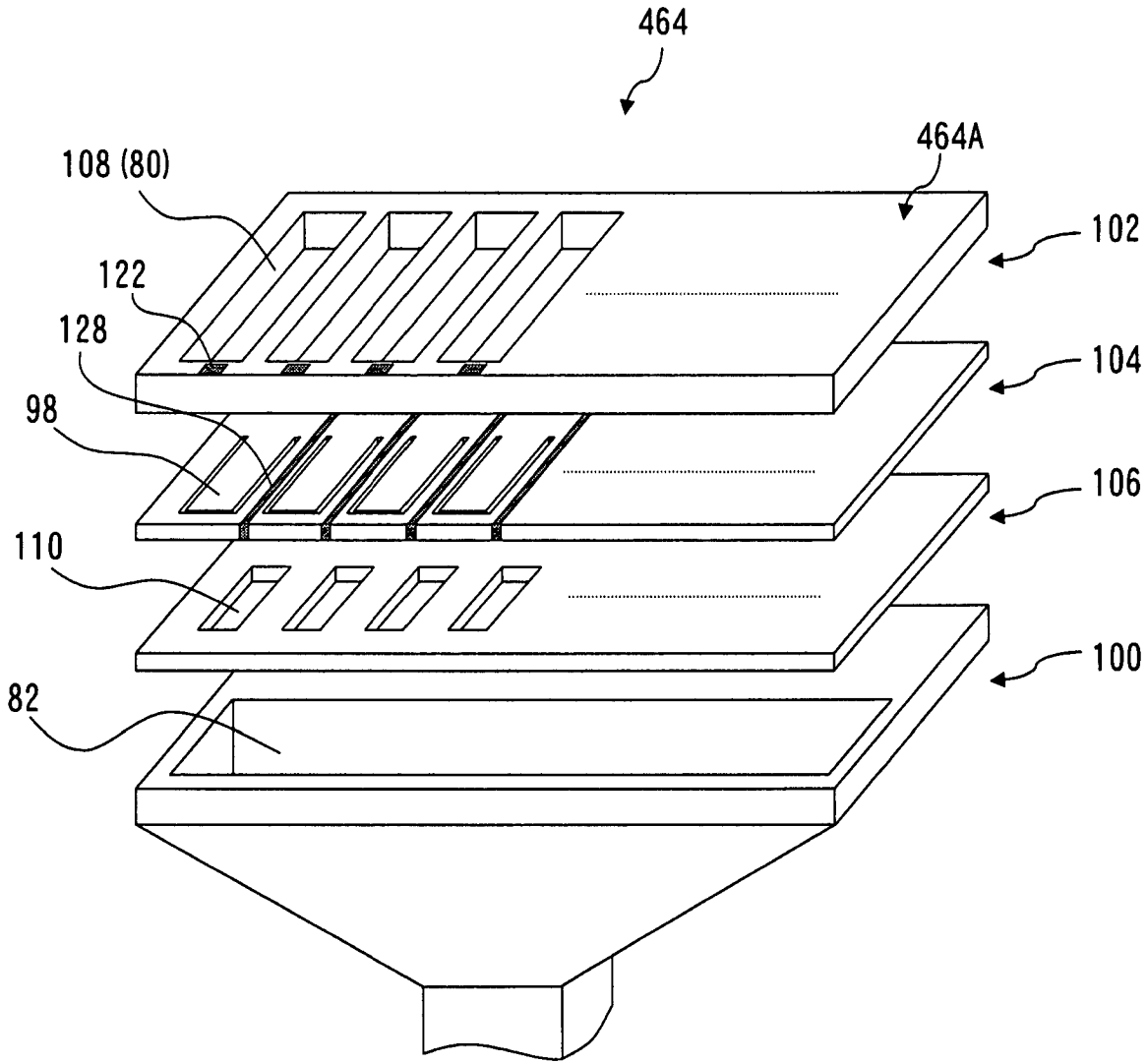
FIG. 12 is an exploded oblique view of the cap according to the fifth embodiment.

FIG. 11 is a diagram showing a fifth embodiment of the present invention, and it is a cross-sectional side view showing a state where a cap 464 is in contact with the nozzle surface 450A of a head 450. FIG. 12 is an exploded oblique view of the cap 464. In FIGS. 11 and 12, items which are the same as or similar to those in FIGS. 6A to 10 are labeled with the same reference numerals, and description thereof is omitted here.

The fifth embodiment adopts a mode in which the electromagnets 96 of the fourth embodiment (see FIG. 9) are substituted by charged plates 112. An insulating layer 114 is provided so as to cover the periphery of each charged plate 112 (apart from the nozzle surface 450A side). Cathode of a power source 116 is connected to each charged plate 112. Anode of the power source 116 is connected to the diaphragm 56 through a switch 118, and the diaphragm 56 is earthed.

Furthermore, electrodes 120 and 122 are provided in the head 450 and the cap 464 respectively. Anode of a power source 124 is connected to each electrode 120 of the head 450. Cathode of the power source 124 is connected to the diaphragm 56 via a switch 126. On the other hand, each electrode 122 of the cap 464 is connected to the second substrate (metal plate) 104. As shown in FIG. 11, in a state where the cap 464 is abutted against the nozzle surface 450A of the head 450, the electrodes 120 and 122 are mutually opposing and make contact with each other, and hence power can be supplied from the head 450 side to the cap 464 side.

When the ink is to be suctioned, the switches 118 and 126 in the head 450 are closed, and thus the charged plate 112 of the head 450 is charged positively, whereas the valve section 98 in the cap 464 is charged negatively. The valve section 98 is thus displaced toward the first flow channel 80 as denoted by the broken line in FIG. 11, and the first flow channel 80 is connected with the second flow channel 82. Therefore, when the suction pump 67 (not shown) is operated, the ink is suctioned from a nozzle column 70 corresponding to that first flow channel 80.

On the other hand, when the ink is not to be suctioned, the switches 118 and 126 are opened, and the first flow channel 80 is disconnected from the second flow channel 82 by the valve section 98. Therefore, even if the suction pump 67 (not shown) is operated, the ink in a nozzle column 70 corresponding to that first flow channel 80 is not suctioned.

As shown in FIG. 12, a plurality of valve sections 98 are provided in the second substrate 104 forming the cap 464 so as to correspond respectively to the first flow channels 80 of the first substrate 102, and insulating members 128 are provided between the valve sections 98 in such a manner that the valve sections 98 can be displaced individually.

According to the fifth embodiment, similarly to the first to fourth embodiments described above, it is possible to implement ink suctioning selectively for each nozzle column 70, and therefore wasteful consumption of the ink can be reduced. Furthermore, by adopting a mode in which the power is supplied from the head 450 side to the cap 464 side, it is possible to simplify the composition of the cap 464 yet further.

Sixth Embodiment

Figure 13:
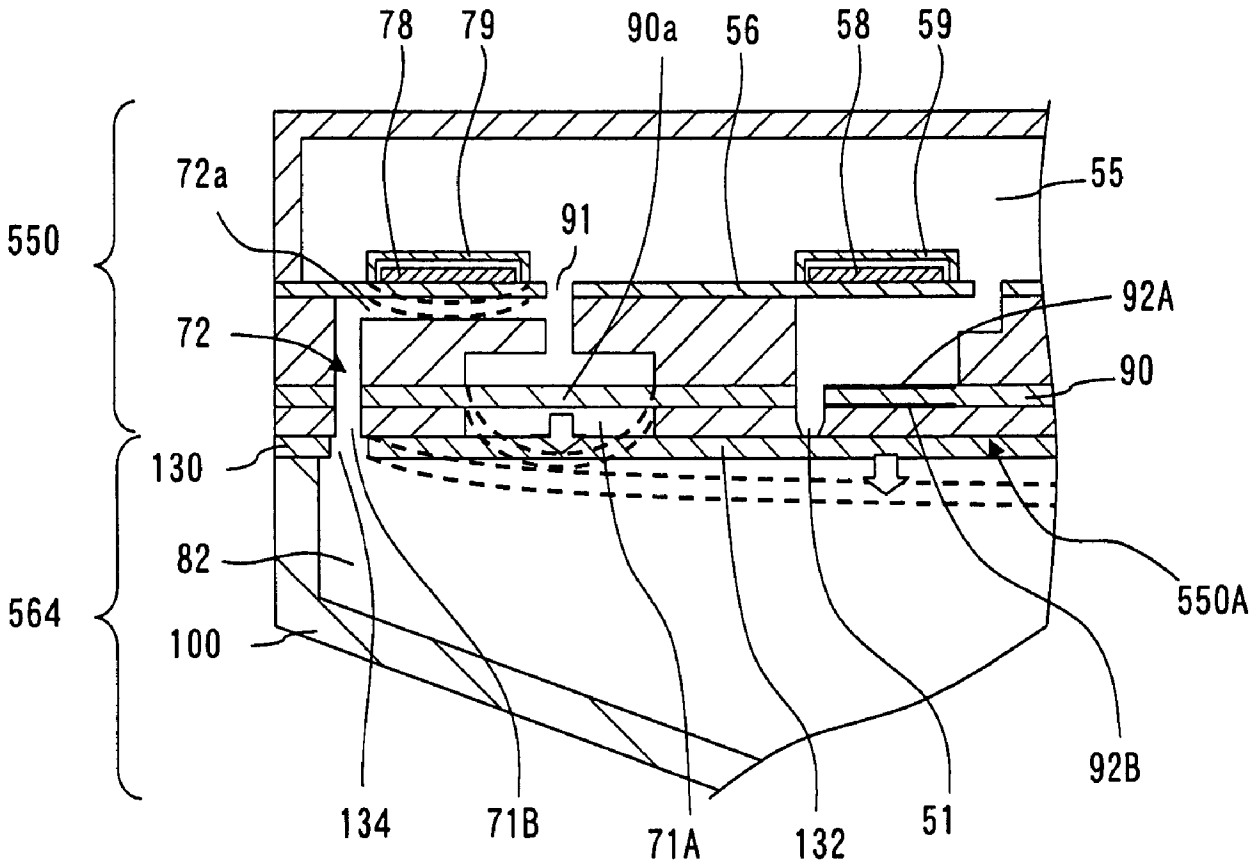
FIG. 13 is a cross-sectional side view showing a head and a cap according to a sixth embodiment.
Figure 14:
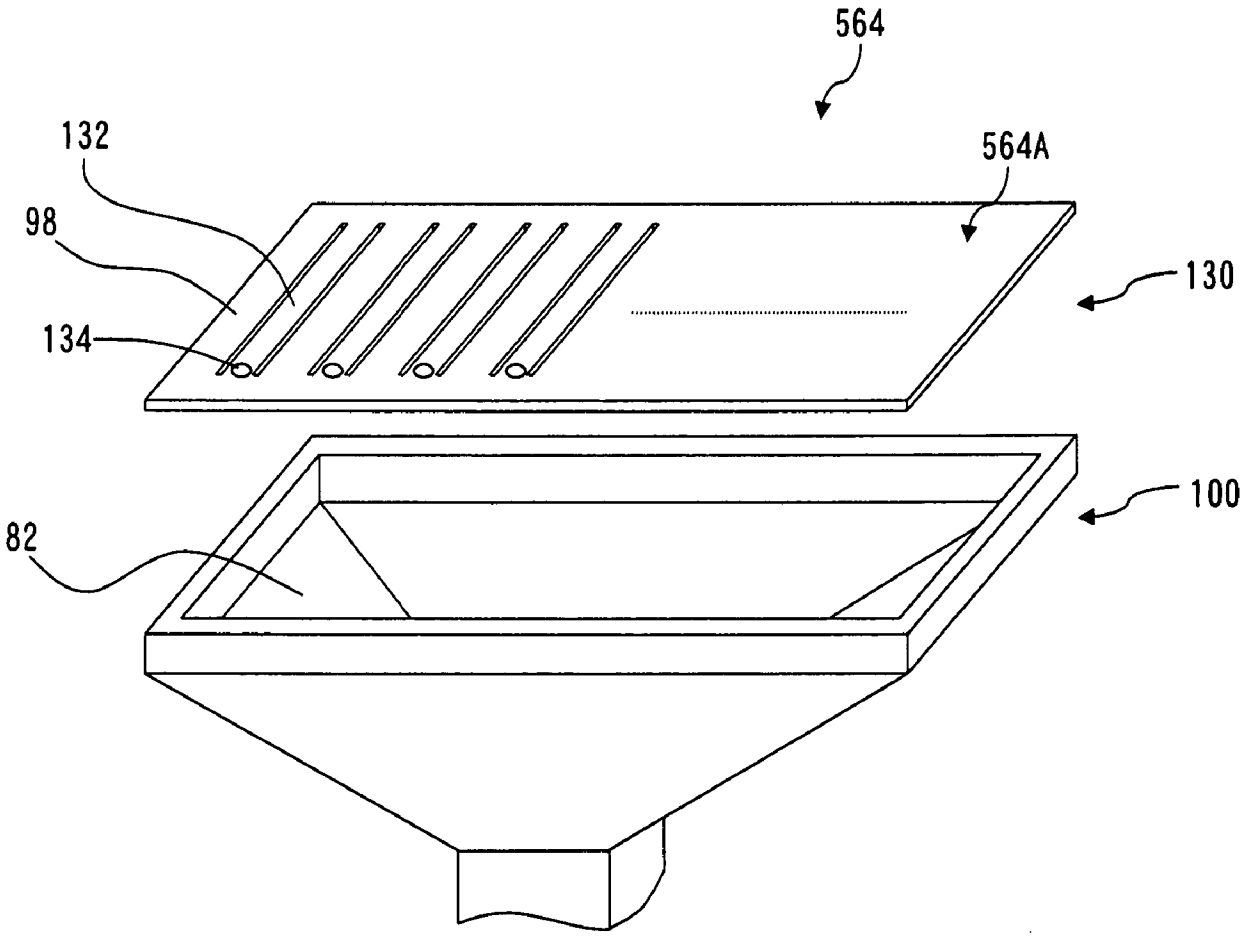
FIG. 14 is an exploded oblique view of the cap according to the sixth embodiment.

FIG. 13 is a diagram showing a sixth embodiment of the present invention, and it is a cross-sectional side view showing a state where a cap 564 is in contact with the nozzle surface 550A of a head 550. FIG. 14 is an exploded oblique view of the cap 564. In FIGS. 13 and 14, items which are the same as or similar to those in FIGS. 6A to 12 are labeled with the same reference numerals, and description thereof is omitted here.

In the sixth embodiment, as shown in FIGS. 13 and 14, the surface (abutting surface) of the cap 564 is formed by a rubber film 130. Furthermore, instead of the first flow channels 80 according to the embodiments described above, displacement sections 132 which are formed by providing the rubber film with cut lines that form the either side of each displacement section 132 are provided so as to correspond respectively to the nozzle columns 70, following the angle of inclination of the nozzle columns 70 in the head 550 (see FIG. 3). Openings 134 corresponding to the suction holes 71B of the head 564 are provided at one end of each displacement section 132.

When the ink is to be suctioned, as shown by a broken line in FIG. 13, the piezoelectric element 78 is driven and the horizontal flow channel 72*a* is partially in a closed state. Thus, if the suction pump 67 (not shown) is operated, then the coupling film 90*a* is displaced so as to push the displacement section 132 of the rubber film 130 downward, thereby opening the precut portions formed at either side of the displacement section 132. Therefore, the ink in a nozzle column 70 (not shown) corresponding to that displacement section 132 is suctioned.

On the other hand, if the ink is not to be suctioned, then the piezoelectric element 78 is not driven and the horizontal flow channel 72*a* is in an open state. Furthermore, the coupling film 90*a* is not displaced and the precut portions forming either side of the displacement section 132 of the rubber film 130 are in a closed state. In other words, a nozzle column 70 corresponding to the displacement section 132 is in a closed state by the displacement section 132. Therefore, even if the suction pump 67 (not shown) is operated, the ink in the nozzle column (not shown) corresponding to that displacement section 132 is not suctioned.

According to the sixth embodiment, similarly to the first to fifth embodiments described above, it is possible to implement ink suctioning selectively for each nozzle column 70, and therefore wasteful consumption of the ink can be reduced.

Seventh Embodiment

Figure 15:
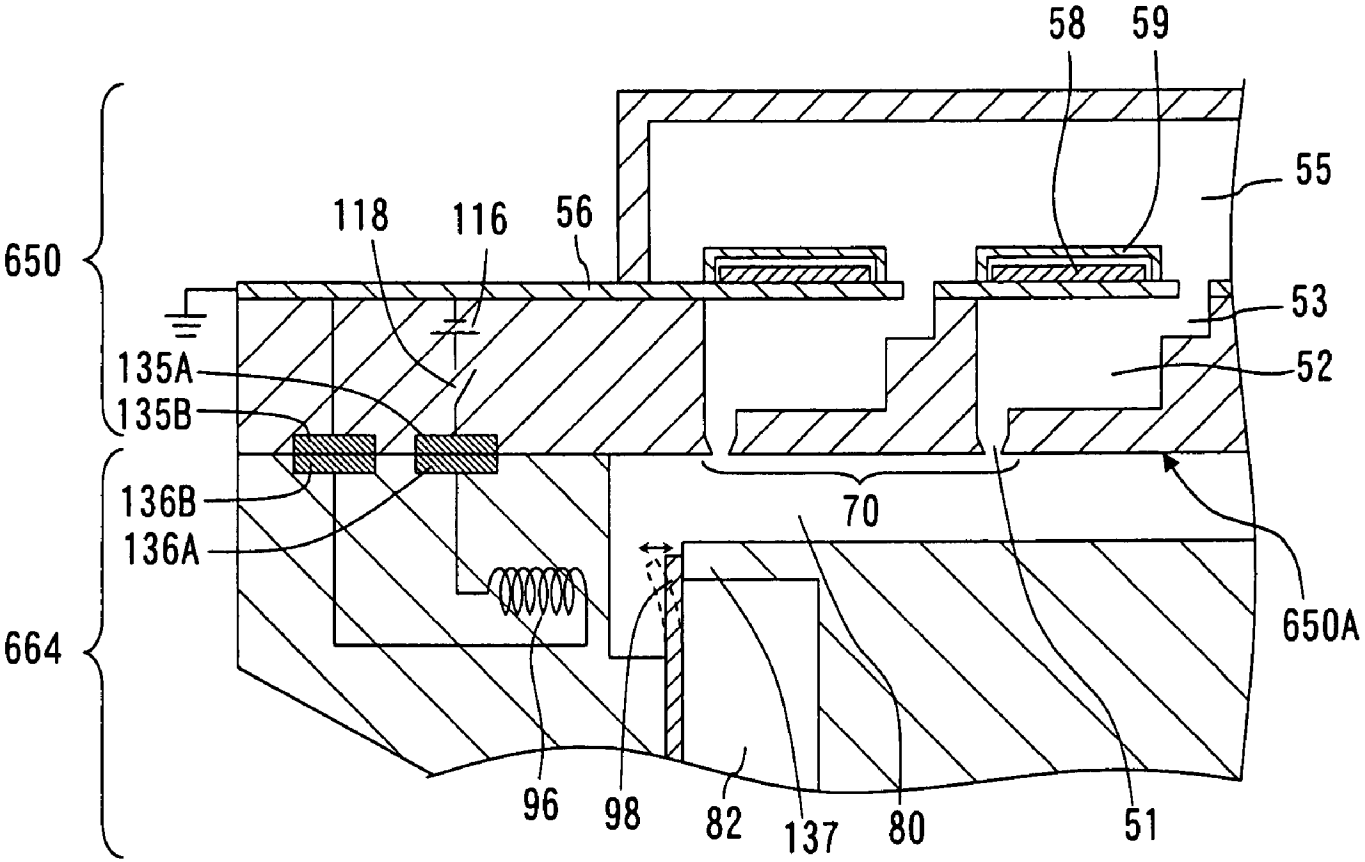
FIG. 15 is a cross-sectional side view showing a head and a cap according to a seventh embodiment.

FIG. 15 is a diagram showing a seventh embodiment of the present invention, and it is a cross-sectional side view showing a state where a cap 664 is in contact with the nozzle surface 650A of a head 650. In FIG. 15, items which are the same as or similar to those in FIGS. 6A to 14 are labeled with the same reference numerals and description thereof is omitted here.

The seventh embodiment is a modification which combines the fourth and fifth embodiments, and a mode is adopted in which electromagnets 96 and valve sections 98 are provided in the cap 664. The valve sections 98 are made of metal, or a plate that is subjected to attraction force by a magnet (for example, a resin plate on which metal has been vapor-deposited).

In a state where the cap 664 is in contact with the nozzle surface 650A of the head 650, electrodes 135A and 135B of the head 650 respectively make contact with electrodes 136A and 136B of the cap 664, and hence electrical power can be supplied to each electromagnet 96 in the cap 664, from the power source 116 in the head 650. A switch 118 is connected to the power source 116, and the displacement of the valve section 98 which is positioned so as to oppose the electromagnet 96 can be controlled by means of the open or closed state of the switch 118.

When the ink is to be suctioned, a state where the electric power can be supplied from the head 650 is set, in other words, the switch 118 is closed, and the valve section 98 is displaced toward the electromagnet 96 as denoted by the broken line in FIG. 15, thereby connecting the first flow channel 80 with the second flow channel 82. Therefore, when the suction pump 67 (not shown) is operated, the ink is suctioned from a nozzle column 70 corresponding to that first flow channel 80.

On the other hand, when the ink is not to be suctioned, a state where the electric power cannot be supplied from the head 650 is set, in other words, the switch 118 is opened, and the valve section 98 comes in contact with the partition 137. The first flow channel 80 is hence disconnected from the second flow channel 82. Therefore, even if the suction pump 67 (not shown) is operated, the ink in a nozzle column 70 corresponding to that first flow channel 80 is not suctioned.

According to the seventh embodiment, similarly to the first to sixth embodiments described above, it is possible to implement ink suctioning selectively for each nozzle column 70, and therefore wasteful consumption of the ink can be reduced. Furthermore, since a composition is adopted in which the power can be supplied from the head 650 side to the cap 664 side, then it is possible to simplify the structure of the cap 664.

Eighth Embodiment

Figure 16:
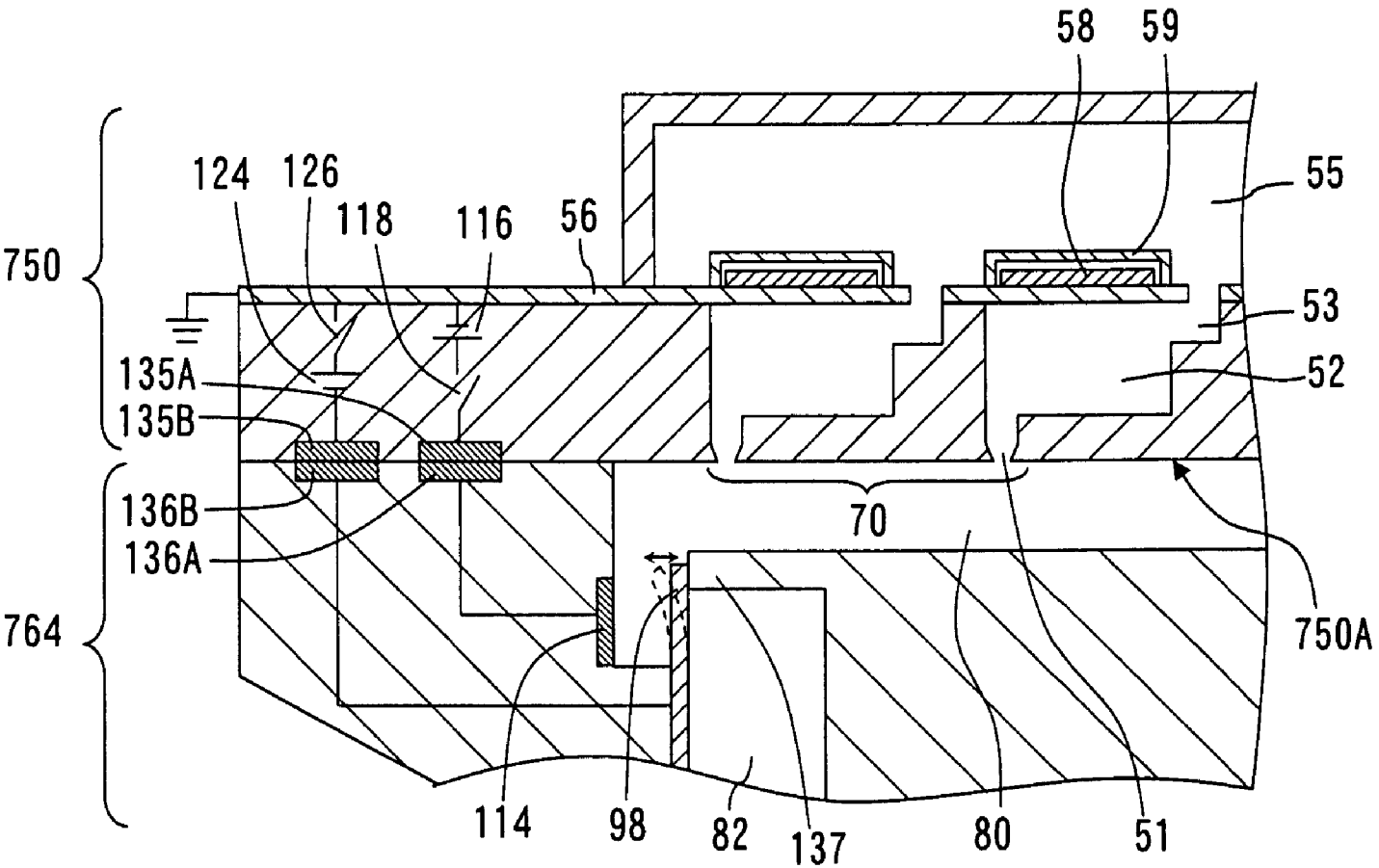
FIG. 16 is a cross-sectional side view showing a head and a cap according to an eighth embodiment.

FIG. 16 is a diagram showing an eighth embodiment of the present invention, and it is a cross-sectional side view showing a state where a cap 764 is in contact with the nozzle surface 750A of a head 750. In FIG. 16, items which are the same as or similar to those in FIGS. 6A to 15 are labeled with the same reference numerals and description thereof is omitted here.

The eighth embodiment adopts a mode in which charged plates 114 are provided instead of the electromagnets 96 of the seventh embodiment (see FIG. 15). The charged plates 114 are disposed at prescribed positions in such a manner that the charged plates 114 oppose to the valve sections 98, and the valve sections 98 are displaced in accordance with the state of power supply from the head 750 to the cap 764. The operation during the suctioning ink and during non-suctioning ink is similar to that of the seventh embodiment described above, and description thereof is omitted here.

According to the eighth embodiment, similarly to the first to seventh embodiments described above, it is possible to implement ink suctioning selectively for each nozzle column 70, and therefore wasteful consumption of the ink can be reduced.

Ninth Embodiment

Figure 17:
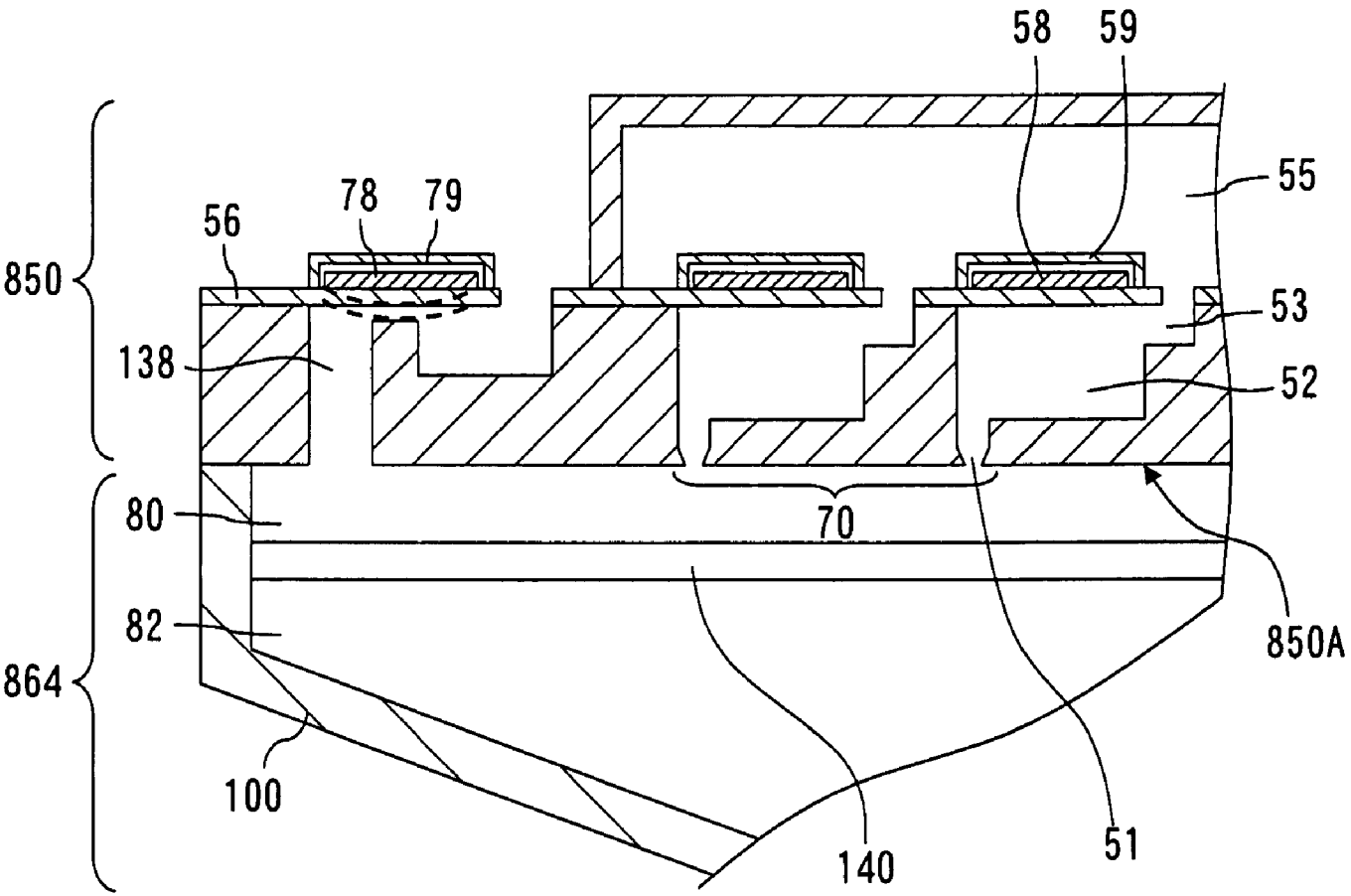
FIG. 17 is a cross-sectional side view showing a head and a cap according to a ninth embodiment.
Figure 18A:
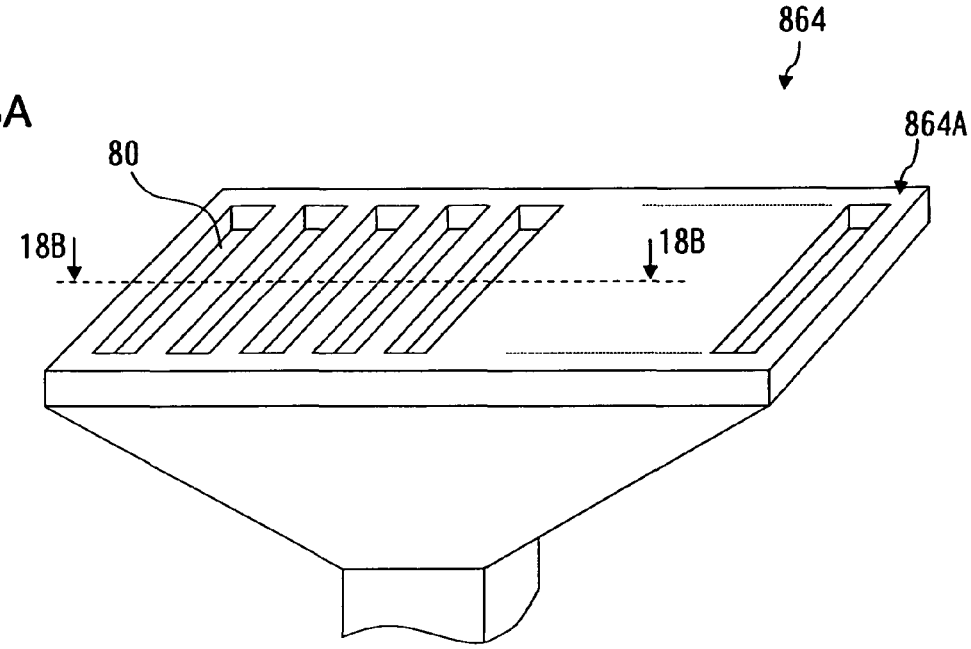
FIGS. 18A and 18B are an oblique external view and a partial cross-sectional side view of the cap according to the ninth embodiment, respectively.
Figure 18B:
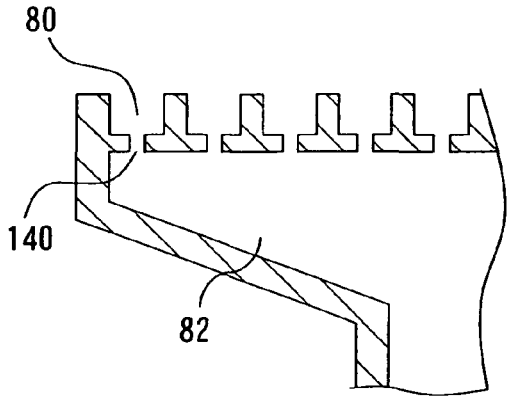

FIG. 17 is a diagram showing a ninth embodiment of the present invention, and it is a cross-sectional view showing a state where a cap 864 is in contact with the nozzle surface 850A of a head 850. FIG. 18A is an oblique external view of the cap 864, and FIG. 18B is a partial cross-sectional side view of the cap 864 (a cross-sectional diagram along line 18B-18B in FIG. 18A). In FIGS. 17, 18A, and 18B, items which are the same as or similar to those in FIGS. 6A to 16 are labeled with the same reference numerals, and description thereof is omitted here.

As shown in FIG. 17, the ninth embodiment adopts a mode in which each atmosphere connection path 138 provided in the head 850 is partially opened or closed in accordance with the displacement of each piezoelectric element 78. The atmosphere connection paths 138 are provided for the nozzle columns 70 respectively, and one end of each atmosphere connection path 138 is open on the nozzle surface 850A side, while the other end is open on the reverse side (i.e., the diaphragm 56 side). Furthermore, as shown in FIGS. 18A and 18B, each of the first flow channels 80 is connected to the second flow channel 82 via a restrictor section 140 which has a narrower width than each first flow channel 80. When the ink is retained in each of the restrictor sections 140, the surface of the ink (i.e., so-called meniscus of the ink) is formed at each restrictor section 140.

When the ink is to be suctioned, the piezoelectric element 78 is driven, and the atmosphere connection path 138 is partially closed as denoted with the broken line in FIG. 17. In this state, if the suction pump 67 (not shown) is operated, the ink in a nozzle column 70 corresponding to the first flow channel 80 can be suctioned.

On the other hand, when the ink is not to be suctioned, the piezoelectric element 78 is not driven and the atmosphere connection path 138 is in an open state. In this case, even if the suction pump 67 (not shown) is operated, since the pressure inside the first flow channel 80 can be kept within a range from the atmospheric pressure to the atmospheric pressure plus or minus several kPa, then the meniscus in each nozzle section is maintained. Therefore, the ink in a nozzle column 70 corresponding to that first flow channel 80 is not suctioned. By adjusting the size of the restrictor sections 140, it is possible to set the pressure that allows the meniscus of the ink in the nozzles 51 to be kept.

According to the ninth embodiment also, similarly to the first to eighth embodiments described above, it is possible to implement ink suctioning selectively for each nozzle column 70, and therefore wasteful consumption of the ink can be reduced. Furthermore, in particular, the structure of the cap 864 becomes simple, and therefore the cap can be readily manufactured.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus comprising:

a liquid ejection head which has a nozzle surface including a plurality of nozzles;

a cap device which comes in contact with the nozzle surface of the liquid ejection head and enables liquid inside the nozzles to be suctioned or pressurized;

first flow channels provided in the cap device, having respective openings in the nozzle surface of the liquid ejection head, and being provided for respective nozzle groups obtained by dividing the plurality of nozzles into at least two groups;

a second flow channel provided in the cap device, the second flow channel having an opening in the nozzle surface of the liquid ejection head, and being connected to a pump;

connection paths respectively provided for each nozzle group in the liquid ejection head, each connection path having two openings in the nozzle surface of the liquid ejection head; and valve sections respectively provided for each nozzle group, and configured to open and close the connection paths, wherein:

the first flow channels and the second flow channel are connected with each other via the connection paths in a state where the cap device is abutted on the nozzle surface of the liquid ejection head, and by causing the valve sections to open or close the connection paths with respect to each of the nozzle groups in the state where the cap device abuts the nozzle surface of the liquid ejection head, suction or pressurization of the liquid in the plurality of nozzles can be carried out selectively.

2. The liquid ejection apparatus as defined in claim 1 further comprising first piezoelectric elements which are respectively provided for the nozzles in the liquid ejection head, wherein the liquid is ejected from each of the nozzles by using displacement of each of the first piezoelectric elements.

3. The liquid ejection apparatus as defined in claim 2, wherein:

the valve sections are formed by second piezoelectric elements that are distinct from the first piezoelectric elements; and the first piezoelectric elements and the second piezoelectric elements have a common structure.

4. The liquid ejection apparatus as defined in claim 3, further comprising coupling films which are respectively provided in the connection paths of the liquid ejection head and are respectively displaced in conjunction with the displacement of the second piezoelectric elements, wherein each of the connection paths is partially opened or closed in accordance with displacement of each of the coupling films.

5. The liquid ejection apparatus as defined in claim 1, further comprising ejection failure determination devices which are provided in the liquid ejection head and each determine a liquid ejection defect, wherein a selection device selects whether or not liquid inside the nozzles is suctioned or pressurized, for each of the nozzle groups, in accordance with determination results of the ejection failure determination devices.

6. The liquid ejection apparatus as defined in claim 5, further comprising:

second piezoelectric elements which are respectively provided on wall surfaces of the connection paths, wherein:

each of the connection paths is partially opened or closed in accordance with displacement of each of the second piezoelectric elements; and at least a portion of each of the ejection failure determination devices constitutes a coupling film which is displaced in conjunction with the displacement of each of the second piezoelectric elements.

7. The liquid ejection apparatus as defined in claim 6, wherein the coupling film which is constituted by at least a portion of each of the ejection failure determination devices is made of polyvinylidene difluoride.

8. An image forming apparatus comprising the liquid ejection apparatus as defined in claim 1.

9. The liquid ejection apparatus as defined in claim 3, wherein the second piezoelectric elements are provided on wall surfaces of the connection paths respectively.

* * * * *